US008562757B2

(12) United States Patent
Tokuda et al.

(10) Patent No.: US 8,562,757 B2
(45) Date of Patent: Oct. 22, 2013

(54) MG-BASED ALLOY PLATED STEEL MATERIAL

(75) Inventors: Kohei Tokuda, Tokyo (JP); Koichi Nose, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 904 days.

(21) Appl. No.: 12/450,195

(22) PCT Filed: Mar. 14, 2008

(86) PCT No.: PCT/JP2008/055189

§ 371 (c)(1),
(2), (4) Date: Sep. 14, 2009

(87) PCT Pub. No.: WO2008/111688

PCT Pub. Date: Sep. 18, 2008

(65) Prior Publication Data

US 2010/0018612 A1 Jan. 28, 2010

(30) Foreign Application Priority Data

Mar. 15, 2007 (JP) ..... 2007-066740
Sep. 19, 2007 (JP) ..... 2007-242561

(51) Int. Cl.
*C22C 38/00* (2006.01)
*B32B 15/18* (2006.01)

(52) U.S. Cl.
USPC ..... 148/320; 428/649; 428/659

(58) Field of Classification Search
USPC ..... 148/320; 428/649, 659
See application file for complete search history.

(56) References Cited

U.S. PATENT DOCUMENTS

| | | | | |
|---|---|---|---|---|
| 5,135,817 | A * | 8/1992 | Shimogori et al. | 428/621 |
| 8,016,955 | B2 * | 9/2011 | Park et al. | 148/403 |
| 2009/0053555 | A1 * | 2/2009 | Nose et al. | 428/653 |

FOREIGN PATENT DOCUMENTS

| | | |
|---|---|---|
| EP | 1 997 927 | 12/2008 |
| EP | 2 042 617 | 4/2009 |
| JP | 59-110517 | 6/1984 |
| JP | 3-10041 | 1/1991 |
| JP | 3-87339 | 4/1991 |
| JP | 03-138389 | 6/1991 |
| JP | 04-052284 | 2/1992 |
| JP | 08-013186 | 1/1996 |
| JP | 08-041564 | 2/1996 |
| JP | 11-193452 | 7/1999 |
| JP | 2002-060978 | 2/2002 |
| JP | 2005-082834 | 3/2005 |
| KR | 1991-0008175 | 5/1991 |

OTHER PUBLICATIONS

NPL: machine translation of JP 11-193452 A, Jul. 1999.*
Hirai, S., et al., "Formation of Low Aluminium Fe-Al Layer on Steel Surface by Hot-Dipping in Molten Mg-Al Bath," J. Japan Inst. Metals, vol. 59, No. 3 (1995) pp. 284-289.
Fukui, Y., et al., "Corrosion Resistance of Zn-Mg Vapor Deposited Steel Sheet," Nisshin Steel Technical Reports, No. 78 (1998), pp. 18-27.
European Search Report dated Dec. 14, 2010 issued in corresponding EP Application No. 08722555.3-1215.
Office Action cited on Apr. 25, 2011 in the corresponding Chinese application No. 2008-80008511.
Korean Office Action cited on Jun. 17, 2011 in the corresponding Korean application No. 10-2009-7018957.
International Search Report dated Jun. 3, 2008 issued in corresponding PCT Application No. PCT/JP2008/055189.

* cited by examiner

*Primary Examiner* — Jie Yang
(74) *Attorney, Agent, or Firm* — Kenyon & Kenyon LLP

(57) ABSTRACT

An Mg-based alloy plated steel material superior in adhesion and corrosion resistance characterized by being provided with a hot dip Mg-based alloy plating layer (preferably containing Zn: 15 atm % to less than 45 atm %).

10 Claims, 24 Drawing Sheets

Temperature,°C
1100
1000
900
800
700
600
500
400
300
200
Cu
0
10
20
30
40
50
60
70
80
90
100
Mg
at.%
1083
727
800
552
568
487
648
L
(Cu)
MgCu2
Mg2Cu
(Mg)

MG-BASED ALLOY PLATED STEEL MATERIAL

This application is a national stage application of International Application No. PCT/JP2008/055189, filed 14 Mar. 2008, which claims priority to Japanese Application Nos. 2007-066740, filed 15 Mar. 2007; and 2007-242561, filed 19 Sep. 2007, each of which is incorporated by reference in its entirety.

TECHNICAL FIELD

The present invention relates to an Mg-based alloy plated steel material provided with a high Mg composition alloy (Mg-based alloy).

BACKGROUND ART

As a hot dip metal plated steel material, a hot dip Zn plated steel material is being used in a wide range of fields such as automobiles, building materials, household electrical appliances, etc. In general, a high amount of deposition of plating is effective for the purpose of securing a long-term rust-proofing effect.

This is because with a Zn plating, the rate of corrosion of the plating layer itself is slower than that of the iron metal of the steel material and even at locations where the iron metal is exposed, the low corrosion potential Zn exhibits a sacrificial corrosion-proofing ability with respect to the steel material.

These corrosion resistant and corrosion-proofing effects are obtained by the consumption of the Zn, so the greater the amount of Zn per unit area, the longer the time the corrosion resistant and corrosion-proofing effect can be maintained.

On the other hand, if the amount of deposition of Zn becomes greater, the workability, weldability, and other characteristics required for a steel material tend to deteriorate. For this reason, in Zn plating, if possible, exhibition of a high corrosion resistance by a smaller amount of deposition is being sought.

Further, in recent years, the depletion of Zn resources has been considered a problem. To reduce the amount of use of Zn, Zn plating having a high corrosion resistance by a low amount of deposition is being sought.

To obtain a sufficient corrosion resistance by a low amount of deposition of Zn plating, an alloy element is added to the Zn plating to improve the corrosion resistance. Up until now, numerous attempts have been made. In actuality, Zn—Ni alloy platings, Zn—Fe alloy platings, etc. are being widely used particularly for automobile steel sheet. Zn—Al alloy platings are also being widely used most for building materials.

In particular, to further improve the corrosion resistance in Zn—Al alloy platings, methods of adding Mg or Si are being developed. For example, the alloy plating layer of the steel superior in corrosion resistance disclosed in Japanese Patent Publication (A) No. 2002-60978 contains, by mass %, Al: 1 to 50% and Mg: 0.1 to 20%.

Further, in the Zn—Mg alloy plating disclosed in Japanese Patent Publication (A) No. 2005-82834, the alloy plating layer contains, by mass %, 0.05 to 3% of Mg, whereby corrosion resistance is obtained. In this prior art, the Mg content of the plating layer is at most, by mass %, 20% or so.

In this way, in the prior art, the content of Mg has been kept low. There are mainly three reasons for this:

The first reason is that if adding Mg in a high concentration, the possibility of rising the melting point of the plating bath rises and that even after plating, the possibility of formation of intermetallic compounds causing deterioration of the workability rises.

When adding Mg to the Zn bath, the Mg can relatively easily dissolve there up to, by mass %, 3% or so. This is because the added Mg forms $MgZn_2$ (intermetallic compound) and this $MgZn_2$ forms a eutectic composition with Zn and causes the melting point to drop.

However, if adding Mg over 3%, the amount of formation of $MgZn_2$ increases and result deviates from a eutectic composition, so the melting point of the plating bath rapidly rises and the viscosity of the plating bath rises.

Furthermore, if the amount of addition of Mg becomes close to 20%, the added Mg forms insolubles and the amount of dross produced increases. The Mg accumulates in the dross at the plating bath surface in a high concentration. Depending on the atmosphere, this ignites at the bath surface. Plating becomes difficult.

Further, if adding Mg in a high concentration of 10% or more, intermetallic compounds and an alloy layer are formed in large amounts in the alloy plating layer after solidification.

The intermetallic compounds present in the alloy plating layer and the alloy layer formed at the boundary of the steel sheet and plating layer are poor in plastic deformability, so if using a plating bath composition containing Mg in a high concentration, a plating layer poor in workability is formed and the problems of cracking of the plating layer and peeling from the steel sheet become remarkable.

Due to the above conditions enabling formation of plating and the problem of workability of the plating layer, up until now the amount of Mg added has been considered limited to around a mass % of around 20%.

The second reason why the Mg content has been kept low is that Mg is poor in reactivity with Fe. Mg does not form intermetallic compounds with Fe and does not dissolve Fe at all (for example, *Journal of the Japan Institute of Metals*, vol. 59, no. 3 (1995), p. 284 to 289).

Further, Mg easily oxidizes. An oxide film of Mg causes deterioration of the wettability with Fe resulting in the adhesion deteriorating.

Even with Zn—Mg alloy plating or Zn—Mg—Al alloy plating, the active amount of Zn or Al becomes smaller due to the added Mg. The formation of an Zn—Fe alloy layer or Al—Fe alloy layer contributing to adhesion between the plating layer and Fe is therefore suppressed.

As a result, in Zn—Mg alloy plating, the higher the concentration of Mg, the more difficult it is to secure adhesion. At the time of working, the plating layer easily peels off etc. It was therefore only possible to fabricate an alloy plated steel material inferior in material properties.

The third reason why the Mg content has been kept low is that it had been believed that with a plating composition containing Mg in a high concentration, the corrosion resistance becomes poor.

Mg oxidizes the easiest among practical use metals, so even with alloy plating with an Mg concentration of a mass % of 50% or more, it had been believed that the Mg would oxidize and the corrosion resistance would become poor and practicality would be lacking.

Due to these reasons, a steel material provided with a hot dip Zn plating layer containing Mg in a high concentration has concerns in terms of production and performance and has not existed up to now.

A method of producing plated steel sheet provided with a Zn—Mg alloy plating layer containing 35 mass % or more of Mg by electroplating is disclosed in Japanese Patent Publication (A) No. 8-13186.

Up until now, the methods for producing plated steel material provided with a Zn—Mg plating layer containing Mg in a high concentration have all been inefficient methods such as electroplating methods using molten salts or nonaqueous solvents. A method of production using the superior efficiency hot dip plating method has not yet been proposed.

Further, the method of producing Zn—Mg plated steel sheet using the vapor deposition plating method utilizing the low melting point and high vapor pressure of Mg has been disclosed in "*Nisshin Steel Technical Reports*, No. 78 (1998), 18-27".

According to this method of production, it is believed possible to produce plated steel sheet provided with a plating layer containing Mg in a high concentration, but vapor deposition in the order of Zn→Mg→Zn is necessary. If compared with the hot dip plating method, it is an inefficient method of production.

Further, the concentration of Mg of the plating layer of a Zn—Mg plated steel sheet produced by the method of production disclosed in "*Nisshin Steel Technical Reports*, No. 78 (1998), 18-27" is 11 to 13 mass %. A Mg—Zn alloy plating layer containing Mg in a high concentration is not being studied and its performance has not been disclosed at all.

The concentration of Mg of the plating layer of the hot dip plated steel materials disclosed up to now has been at most, by mass %, just 20%. Almost all research in this field has been limited to the range of Mg of 20% or less.

Up to now, hot dip plating containing Mg in a high concentration has actually never even come under study. Therefore, the properties of a hot dip plating layer containing Mg in a high concentration also have never been clarified up to now.

DISCLOSURE OF THE INVENTION

The present invention has as its object the provision of a hot dip metal alloy plated steel material comprising a plated steel material provided with a hot dip Mg—Zn alloy plating layer containing Mg in a high concentration and achieving both adhesion and corrosion resistance.

The inventors studied the addition of Mg in a high concentration as a means for obtaining a high corrosion resistance in hot dip Zn plating.

As a result, the inventors discovered that if setting the bath composition in a specific range of composition in an Mg-based-Zn plating bath containing Mg in a high concentration, it is possible to lower the melting point of the hot dip plating bath to less than the ignition point of Mg and reduce both the viscosity of the plating bath and amount of production of dross and possible to produce a plated steel material provided with a hot dip Mg-based alloy plating layer. Note that "Mg-based-Zn" will sometimes be referred to below as "Mg—Zn".

Further, the inventors investigated the physical properties and cross-sectional structure of this Mg—Zn alloy plating layer and as a result discovered that in a low Mg alloy plating, formation of a Zn—Fe alloy layer etc. contributing to plating adhesion was suppressed, but if including Mg in a high concentration, if Zn is present in the plating layer to a certain extent, the Fe diffuses from the matrix material to the plating layer and enables adhesion to be secured.

Furthermore, they discovered that the adhesion of an Mg-based-Zn alloy plating layer with a steel sheet is further improved if preplating is applied to the steel sheet with a metal film of Ni, Cu, Sn, etc.

Further, the inventors discovered that at part of the range of composition of the present invention, it is possible to form an amorphous phase with a practical cooling rate and that if the amorphous phase becomes a volume percentage of 5% or more, defects forming the starting points of peeling and cracking of the plating layer and the detrimental effects of intermetallic compounds can be suppressed.

Further, the inventors discovered that the corrosion resistance of the Mg-based alloy plating layer of the present invention is superior to that of the conventional hot dip Zn plating layer, but by incorporating an amorphous phase, the corrosion resistance is improved over a plating layer of the same composition, but comprising only a crystal phase depending on the conditions of use.

Even if the plating layer is not an amorphous, but crystal phase, in part of the range of composition of the present invention, it is possible to freeze the high temperature stable phase not existing the equilibrium state at room temperature as is until room temperature by a practical cooling rate.

Further, the inventors discovered that a plating layer containing this high temperature stable phase has an extremely superior corrosion resistance and sacrificial corrosion-proofing ability, so can be utilized as a high corrosion resistance and high sacrificial corrosion-proofing ability plating layer never before existing in the past.

The difficulty of forming a plating layer containing an amorphous phase, high temperature stable phase, or other nonequilibrium phase on the steel sheet surface is due to the fact that after hot dip plating, it is necessary to cool the plating layer by a large cooling rate.

The inventors studied targeting easily forming a hot dip Mg—Zn alloy plating layer containing this nonequilibrium phase on the steel sheet surface and separating the hot dip plating process and cooling process.

As a result, they reached the series of heat processes of reheating and rapidly cooling hot dip Mg—Zn alloy plated steel sheet allowed to naturally cool after plating (below, this reheating and rapid cooling sometimes being referred to as "reheating/rapid cooling").

Usually, if plating, then reheating a plated steel material provided with a hot dip plating layer containing Al or Zn, the Fe supplied from the plated steel material and the Al and/or Zn in the plating layer form intermetallic compound (alloy) layers (below, this being sometimes referred to as "alloying").

However, the inventors discovered that by reheating/rapid cooling by specific temperature control in a specific range of composition in the hot dip Mg—Zn alloy plating layer of the present invention, it is possible to suppress Fe and Al alloying or Fe and Zn alloying.

That is, in a specific range of composition, re-melt the plating layer while suppressing alloying is possible. If utilizing this, even with an ordinary plating line not provided with the usual super rapid cooling facilities, it is possible to first perform slow cooling to fabricate a plated steel material provided with an equilibrium phase hot dip Mg—Zn alloy plating, then, off line or on line, reheat and rapidly cool this steel material to produce plated steel sheet provided with a nonequilibrium phase hot dip plating layer.

That is, by separating the rapid cooling process required for obtaining a nonequilibrium phase from the hot dip plating part, it becomes possible to easily form a nonequilibrium phase hot dip Mg—Zn alloy plating layer containing an amorphous phase or high temperature stable phase on the steel material.

The present invention was made based on the above discovery and has as its gist the following:

(1) An Mg-based alloy plated steel material characterized by being provided with a hot dip Mg-based alloy plating layer.

(2) An Mg-based alloy plated steel material characterized by being provided with a hot dip Mg-based alloy plating layer containing Zn: 15 atm % to less than 45 atm %.

(3) An Mg-based alloy plated steel material characterized by being provided with a hot dip Mg-based alloy plating layer containing Zn: 15 atm % to less than 45 atm % and further containing one or more elements selected from a group of elements A: Si, Ti, Cr, Cu, Fe, Ni, Zr, Nb, Mo, and Ag in a total of 0.03 to 5 atm %.

(4) An Mg-based alloy plated steel material characterized by being provided with a hot dip Mg-based alloy plating layer containing Zn: 15 atm % or more and Mg: over 35 atm % and further containing one or more elements selected from the group of elements B: Al, Ca, Y, and La in a total of 0.03 to 15 atm %.

(5) An Mg-based alloy plated steel material characterized by being provided with a hot dip Mg-based alloy plating layer containing Zn: 15 atm % or more and Mg: over 35 atm % and further containing one or more elements selected from the group of elements B: Al, Ca, Y, and La (B1) in a total of 0.03 to 15 atm % when Mg: over 55 atm % and (B2) in a total of 2 to 15% when Mg: 55 atm % or less.

(6) An Mg-based alloy plated steel material as set forth in (4) or (5), characterized in that said hot dip Mg-based alloy plating layer contains Mg: 85 atm % or less.

(7) An Mg-based alloy plated steel material as set forth in (4) or (5), characterized in that said hot dip Mg-based alloy plating layer contains Mg: 55 to 85 atm %.

(8) An Mg-based alloy plated steel material as set forth in any one of (4) to (7) characterized in that said hot dip Mg-based alloy plating layer further contains one or more elements selected from the group of elements A: Si, Ti, Cr, Cu, Fe, Ni, Zr, Nb, Mo, and Ag in a total of 0.03 to 5 atm %.

(9) An Mg-based alloy plated steel material as set forth in any one of (1) to (8) characterized in that said hot dip Mg-based alloy plating layer contains Zn: 15 atm % to less than 45 atm % and contains an amorphous phase in a volume percentage of 5% or more.

(10) An Mg-based alloy plated steel material characterized by being provided with a hot dip Mg-based alloy plating layer containing Zn: 15 atm % to less than 44.97 atm %, further containing one or more elements selected from the composite group of elements of the group of elements A: Si, Ti, Cr, Cu, Fe, Ni, Zr, Nb, Mo, and Ag and the group of elements B': Ca, Y, and La in a total of elements of the group of elements A of 0.03 to 5 atm % and further a total of elements of the group of elements B' of 0.03 to 15 atm % (where, when said total is less than 0.03 to 5 atm %, Mg: over 55 atm % and when 5 to 15 atm %, Zn: less than 40 atm %), and containing an amorphous phase in a volume percentage of 5% or more.

(11) An Mg-based alloy plated steel material as set forth in any one of (1) to (8) characterized in that said hot dip Mg-based alloy plating layer contains an intermetallic compound $Zn_3Mg_7$ in an X-ray intensity ratio (ratio of diffraction peak intensity of $Zn_3Mg_7$ (excluding diffraction peak of diffraction plane spacing of 0.233 nm) in the sum of all diffraction peak intensities appearing at diffraction plane spacing of 0.1089 to 1.766 nm (excluding diffraction peak of diffraction plane spacing of 0.233 nm)) of 10% or more.

(12) An Mg-based alloy plated steel material characterized by being provided with a hot dip Mg-based alloy plating layer containing Zn: 20 atm % or more and Mg: 50 atm % to 75 atm %, further containing one or more elements selected from the group of elements B: Al, Ca, Y, and La in a total of 0.03 to 12 atm % (where when said total is 1 to 12 atm %, containing Al: 1 atm % or more), and containing an intermetallic compound $Zn_3Mg_7$ in a required amount.

(13) An Mg-based alloy plated steel material as set forth in any one of (1) to (8) characterized in that said hot dip Mg-based alloy plating layer contains a nonequilibrium phase obtained by holding said plating layer at a temperature of a melting point of the Mg-based alloy plating to (melting point of Mg-based alloy plating+100° C.) for 1 minute or less, then rapidly cooling it.

(14) An Mg-based alloy plated steel material as set forth in (13), characterized in that said nonequilibrium phase is one or both of an amorphous phase and intermetallic compound $Zn_3Mg_7$.

(15) An Mg-based alloy plated steel material as set forth in (13) or (14) characterized in that said rapid cooling is water cooling or mist water cooling.

(16) An Mg-based alloy plated steel material as set forth in any one of (1) to (15) characterized in that the interface between said hot dip Mg-based alloy plating layer and steel material is provided with a preplating layer comprised of one or more elements selected from Ni, Cu, Sn, Cr, Co, and Ag.

(17) An Mg-based alloy plated steel material as set forth in any one of (1) to (16) characterized in that said hot dip Mg-based alloy plating layer contains a balance of Mg and unavoidable impurities.

The present invention (Mg-based alloy plated steel material) enables production by the usual hot dip plating process, so is superior in universality and economy.

Further, the hot dip Mg—Zn alloy plating layer of the present invention enables a corrosion resistance superior to a conventional hot dip Zn plating layer while keeping down the concentration of Zn, so contributes to the saving of Zn resources.

Further, the hot dip Mg-based alloy plating layer of the present invention is excellent not only in corrosion resistance, but also in workability, so the present invention can be widely used as a structural member or functional member in automobiles, building materials, and household electric appliances.

BEST MODE FOR CARRYING OUT THE INVENTION

Figure 1:
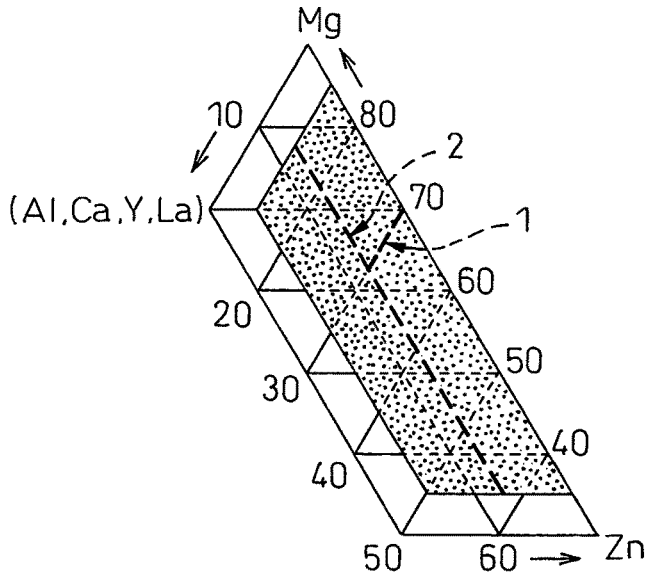
FIG. 1 is a view showing the region of composition where the melting point becomes 580° C. or less due to the addition of Al, Ca, Y, and/or La.

Below, the present invention will be explained in detail.

Inherently, Mg is a metal extremely difficult to deposit on a steel material by the hot dip plating method. This is due to the fact that (i) Mg does not react much at all with Fe and, further, (ii) Mg does not dissolve much in Fe (even if dissolving, about 10 ppm), that is, the poor compatibility of the elements.

For this reason, conversely, it is possible to utilize the poor compatibility to use the steel material as is as a "crucible" material for melting Mg. That is, if using a steel "crucible" for melting the Mg, the "crucible" will not be damaged and the molten Mg can be maintained.

Due to the above reasons and the property of the activity of Mg of easily igniting at the melting point, it has not been possible to form an Mg plating layer or a plating layer of an Mg-based alloy containing Mg in a high concentration (for example, an Mg-based-Zn alloy) on a steel material by the hot dip plating method.

However, Mg is a metal with a low corrosion potential and an extremely superior sacrificial corrosion-proofing effect for a steel material. The inventors took note of this superior point and intensively researched the technique of forming a plating layer of an Mg-based alloy (for example, Mg-based-Zn alloy) containing Mg in a high concentration on the surface of a steel material by the hot dip plating method. As a result, they discovered that (x) If using a plating bath of an Mg-based-Zn alloy comprised of Mg into which a required amount of Zn is added so as to plate steel sheet, it is possible to form an Mg-based-Zn alloy plating layer superior in adhesion with steel sheet on the steel sheet surface.

Note that below, the "alloy plating layer" and "plating layer", unless otherwise particularly explained, mean an "alloy plating layer comprised of a crystal phase" and a "plating layer comprised of a crystal phase".

In the method of formation of an Mg-based alloy plating layer of the present invention, the technique of adding Zn to Mg is employed based on the above discovery (x). That is, in the present invention, the technique of "adding Zn to Mg" forms the basis of the present invention.

If trying to form the Mg-based alloy plating layer of the present invention by the conventional technique of adding high concentration Mg to Zn, along with the increase in the amount of addition of Mg, as explained above, the amount of production of $MgZn_2$ increases, the melting point of the plating bath rises, and the viscosity of the plating rises. Dissolution of Mg into Zn is no longer possible at a certain concentration. The undissolved remaining Mg ends up igniting in the atmosphere.

On the other hand, when adding Zn to Mg like with the technique of addition of the present invention, the above-mentioned phenomenon does not arise. Adding Zn to Mg has not been considered up to now, but the inventors engaged in intensive research and as a result discovered a technique of adding Zn to Mg.

If adding Zn to Mg, since (Mg: 70 atm %-Zn: 30 atm %) is a eutectic composition, if the amount of addition of Zn increases, the viscosity of the plating bath falls.

Figure 25:
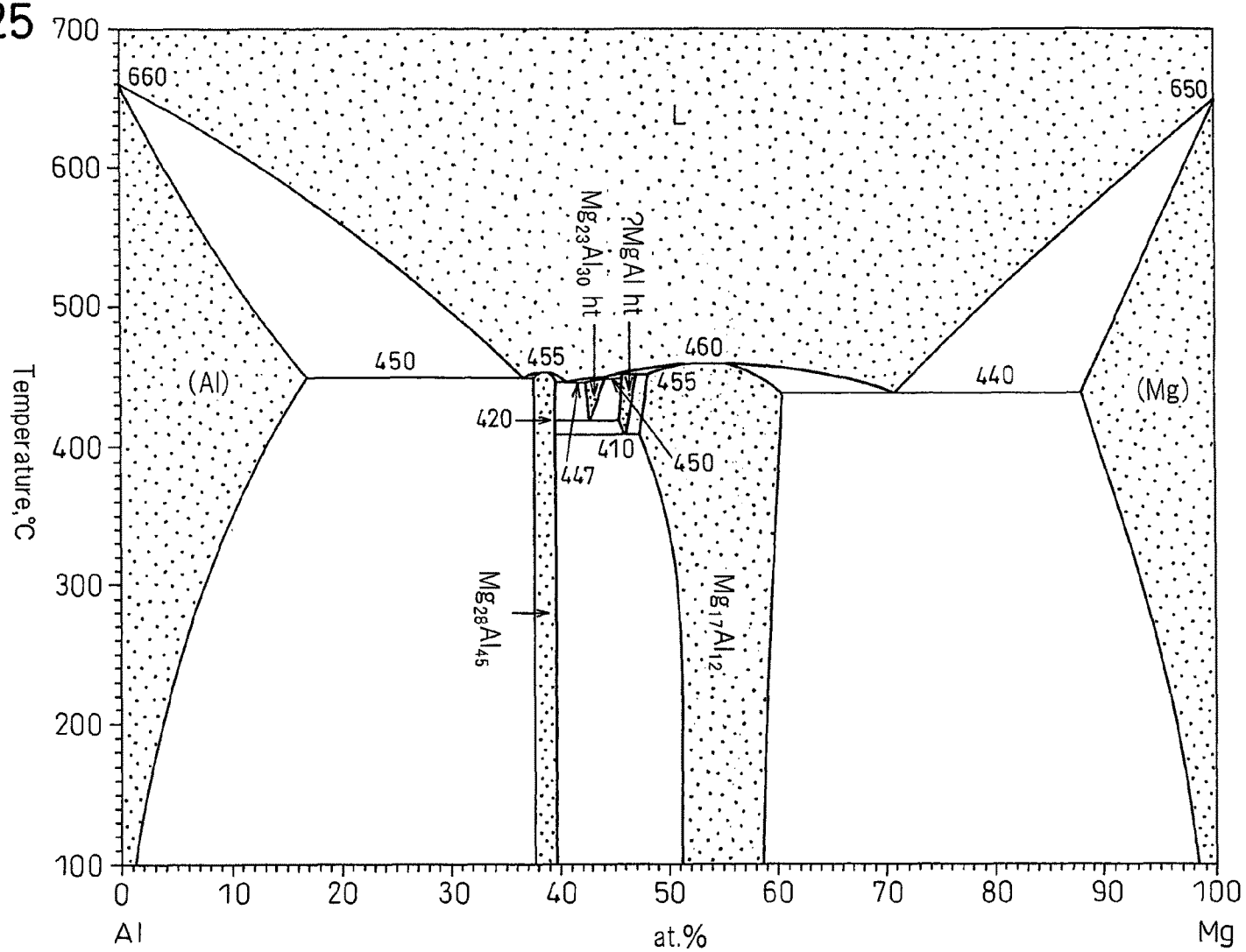
FIG. 25 is a view showing a phase diagram of an Al—Mg alloy.
Figure 26:
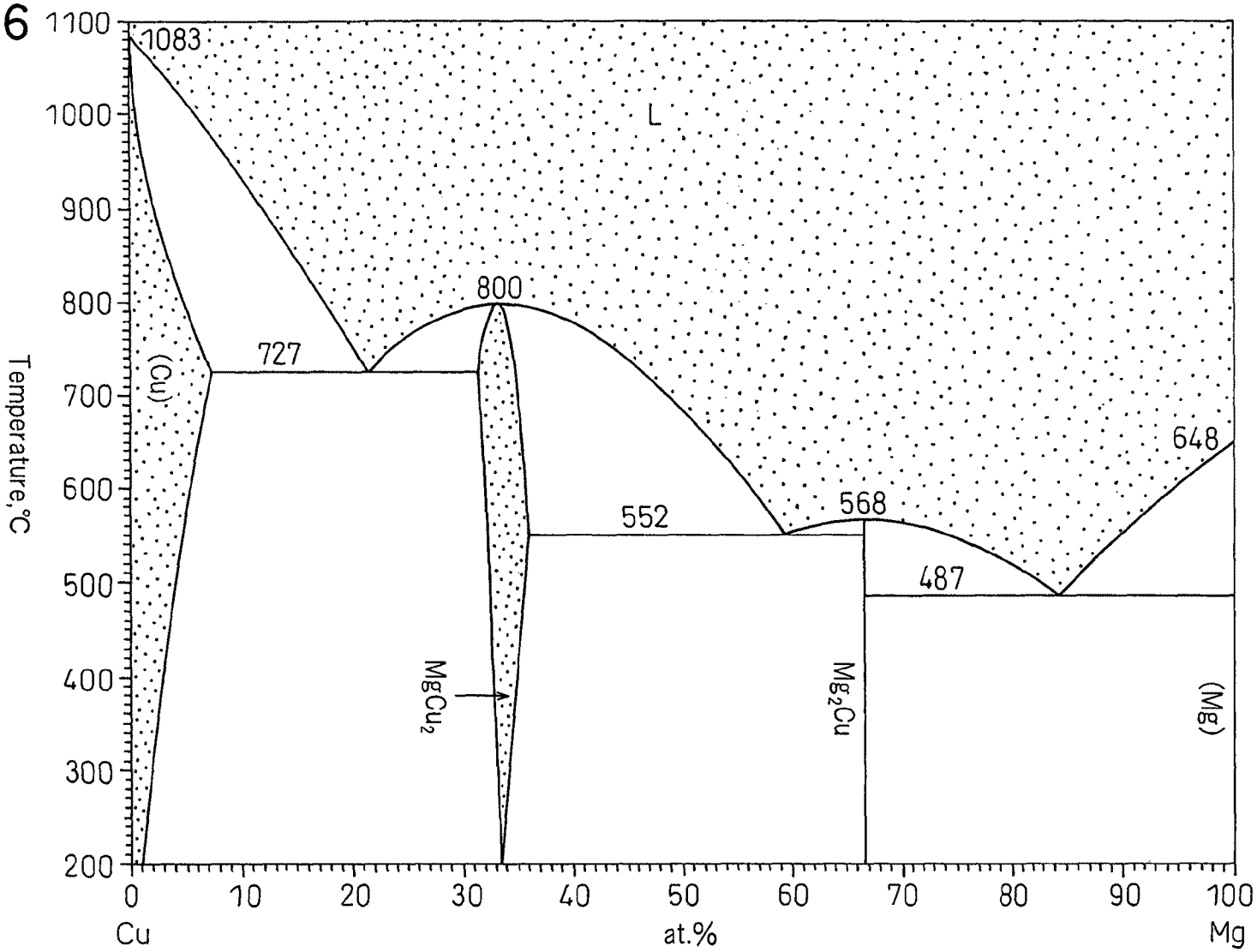
FIG. 26 is a view showing a phase diagram of a Cu—Mg alloy.
Figure 27:
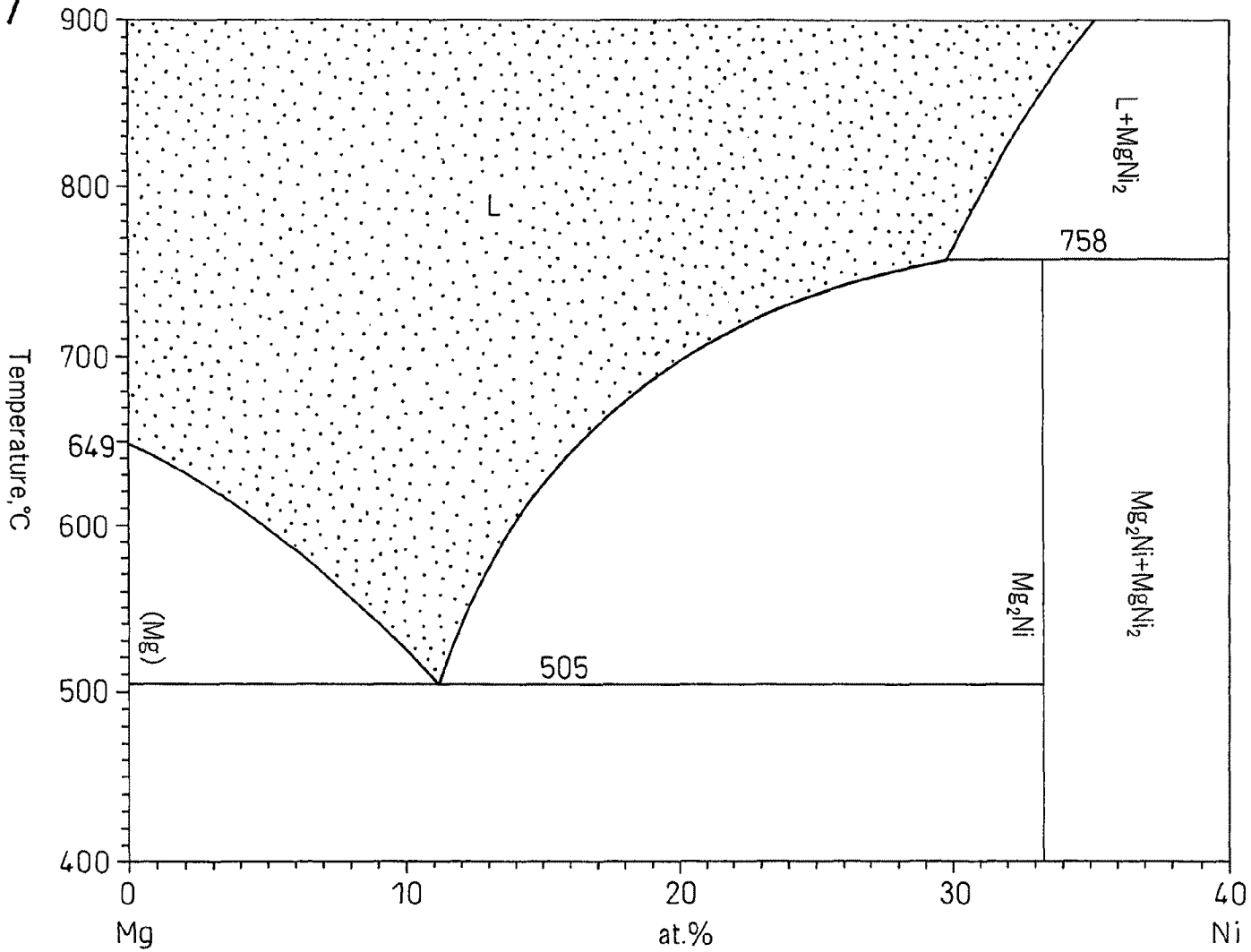
FIG. 27 is a view showing a phase diagram of an Ni—Mg alloy.

As Mg alloys exhibiting phase diagrams similar to a phase diagram of Zn—Mg, there are an Al—Mg alloy, Cu—Mg alloy, and Ni—Mg alloy. For reference, FIG. 25 shows a phase diagram of Al—Mg alloy, FIG. 26 shows a phase diagram of a Cu—Mg alloy, and FIG. 27 shows a phase diagram of Ni—Mg alloy.

As will be understood from these figures, if adding Al, Cu, or Ni in an amount of 10 to 30 atm %, a eutectic composition with Mg is formed. The eutectic composition differs in atomic ratio with the eutectic composition of the Mg—Zn alloy, but Al, Cu, and Ni are elements provided with similar functions to Zn, the inventors believed.

The reason why it was not possible to add a high concentration of Mg to Zn up to now was that at the time of addition of Mg, the intermetallic compound $MgZn_2$ was produced, but in the present invention, the technique of adding Zn to Mg was employed to avoid the production of $MgZn_2$ and therefore formation of an Mg-based-Zn alloy plating layer containing Mg in a high concentration on the steel material surface became possible.

To more simply add Zn to Mg, first, a small amount of high Mg—Zn ingot is prepared in an argon atmosphere. This ingot is melted in the atmosphere and Mg and Zn are alternately added to increase the melted amounts so as not to greatly deviate from the eutectic composition (Mg: 70 atm %, Zn: 30 atm %).

The eutectic composition Mg—Zn alloy melts near 350° C., so it is possible to avoid ignition of the Mg (ignition point 560° C.). The melting of the Mg in the atmosphere is accompanied with the danger of starting fires and explosions, so it is preferable to melt it as much as possible in an argon atmosphere or other inert atmosphere. However, the amount of the Mg—Zn alloy targeted is large, so when it is not possible to prepare the entire targeted amount of Mg—Zn alloy in an argon atmosphere, it is preferable to employ the technique of preparing only the seed alloy in an argon atmosphere in the above way, then alternately add Mg and Zn in the atmosphere.

Note that to suppress the ignition of Mg and the production of black oxides, it is sufficient to add Ca to the Mg at the same time as adding the Zn. The reason why Mg stabilizes due to the addition of Ca is, as one reason, that Ca oxidizes more easily than Mg.

The inventors used the Mg-based alloy plating bath prepared by the method of addition of the present invention so as to form an Mg-based alloy plating layer on a steel sheet and investigated the corrosion morphology at said plated steel sheet.

Furthermore, they compared the results of their investigations and the corrosion morphology in conventional hot dip Zn alloy plated steel sheet.

They subjected the present invention and conventional plated steel sheets to cycle corrosion tests to investigate them.

Figure 15:
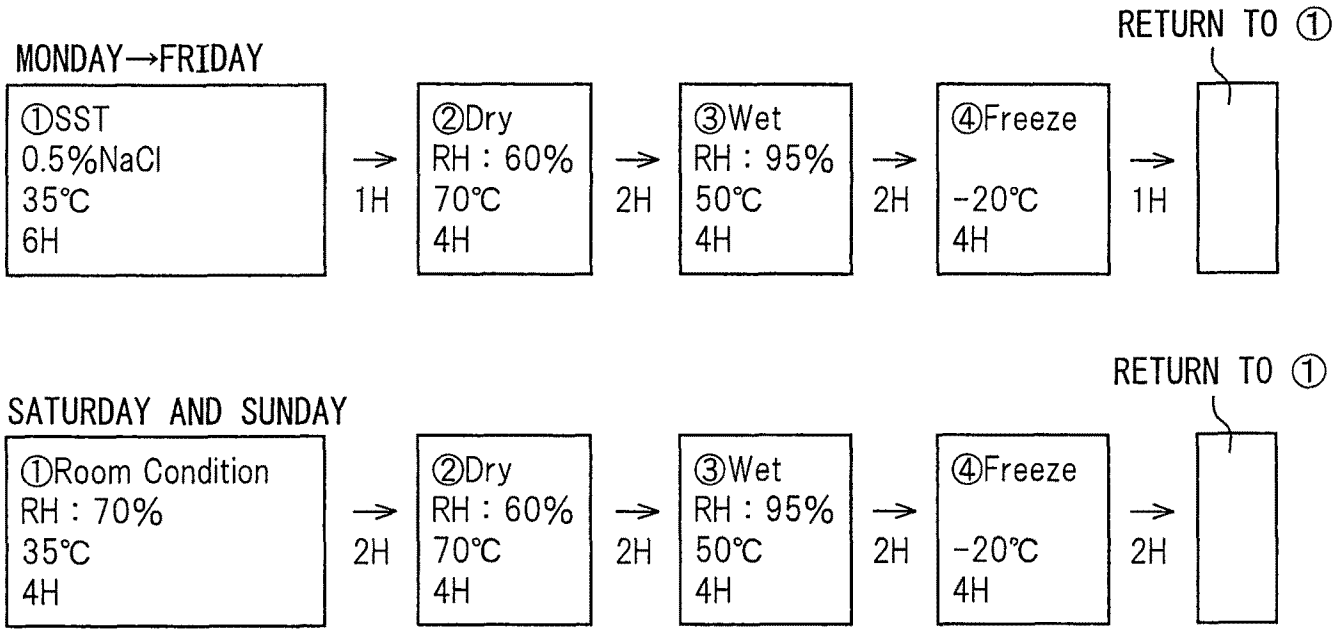
FIG. 15 is a view showing the mode of a cycle corrosion test.

FIG. 15 shows the modes of the cycle corrosion test.

The cyclic corrosion test used here is a corrosion test developed so as to match relatively well the actual state of corrosion in general exposure test. The development was carried out by lowering the salt concentration in the salt spray process of an accelerated corrosion test that had been established as a corrosion test matching well with the actual state of corrosion state of steel sheet for automobiles.

The inventors ran the cycle tests and as a result learned that the corrosion morphology in an Mg-based alloy plated steel material of the present invention substantively differs in the corrosion morphology in conventional hot dip Zn alloy plated steel material. Specifically, they learned the following:

(y) In a plating layer with a sufficiently high Mg concentration, most of the corrosion products are $Mg(OH)_2$, basic magnesium carbonate, and other "corrosion products mainly comprised of Mg".

(z) The "corrosion products mainly comprised of Mg" exhibit a far stronger effect of protection of the iron metal compared with corrosion products mainly comprised of Zn and remarkably suppress the formation of red rust even after all of the plating metal changes to corrosion products.

Here, part of the results of the cycle corrosion tests until obtaining the discovery (y) and the discovery (z) will be explained.

The inventors used the following four types of test materials for cycle corrosion tests:

(1) Steel sheet provided with a 68 atm % Mg-27 atm % Zn-5 atm % Ca alloy plating layer (amorphous, layer thickness: 10 μm) (Invention Test Material 1)

(2) Steel sheet provided with a 68 atm % Mg-27 atm % Zn-5 atm % Ca alloy plating layer (crystalline, layer thickness: 10 μm) (Invention Test Material 2)

(3) Steel sheet provided with a hot dip Zn plating layer (layer thickness: 14 μm) (Comparative Test Material 1 (commercially available material))

(4) Steel sheet provided with a hot dip Zn—Al—Mg alloy plating layer (layer thickness: 12 μm) (Comparative Test Material 2 (commercially available material))

Figure 16:
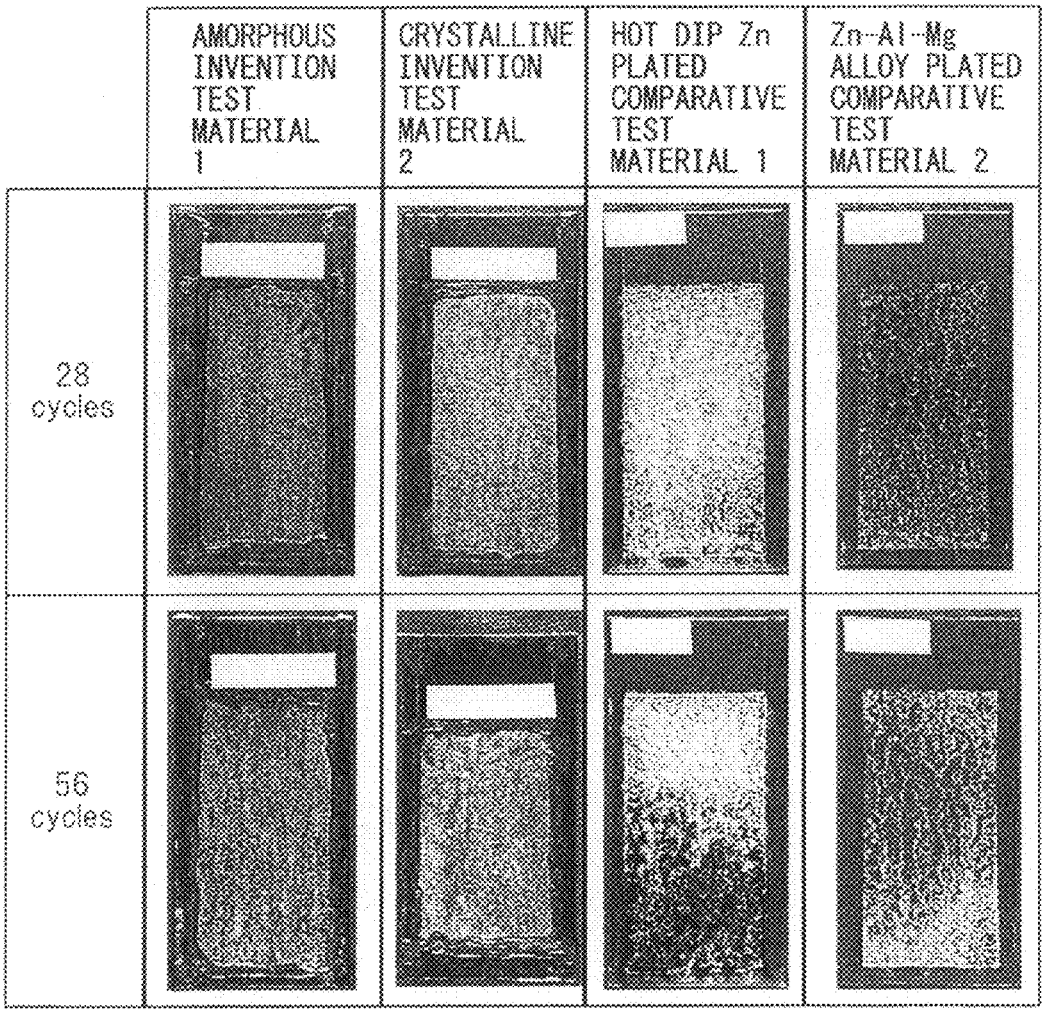
FIG. 16 is a view showing the appearances of corrosion in the results of cycle corrosion tests according to the invention test materials and comparative test materials.

FIG. 16 shows the appearances of corrosion of the results of cycle corrosion tests according to the Invention Test Materials 1 and 2 and Comparative Test Materials 1 and 2.

In Comparative Test Material 1, at 28 cycles, red rust forms on the steel sheet surface and corrosion of the iron metal also occurs. In the other test materials, the surface is covered by the corrosion products and corrosion of the iron metal does not occur.

At 56 cycles, in Comparative Test Material 2, red rust forms on the steel sheet surface and corrosion of the iron metal also occurs. On the other hand, in the Invention Test Materials 1 and 2, red rust does not form on the steel sheet surface and the iron metal is protected.

From these, it will be understood that the hot dip Mg-based alloy plating layer of the present invention is remarkably superior to a conventional Zn plating layer and Zn alloy plating layer in corrosion resistance and sacrificial corrosion-proofing ability.

Next, the inventors examined the cross-section of the plated steel sheet by an optical microscope to examine the corrosion morphology. FIG. 17 to FIG. 20 show the results.

Figure 17:
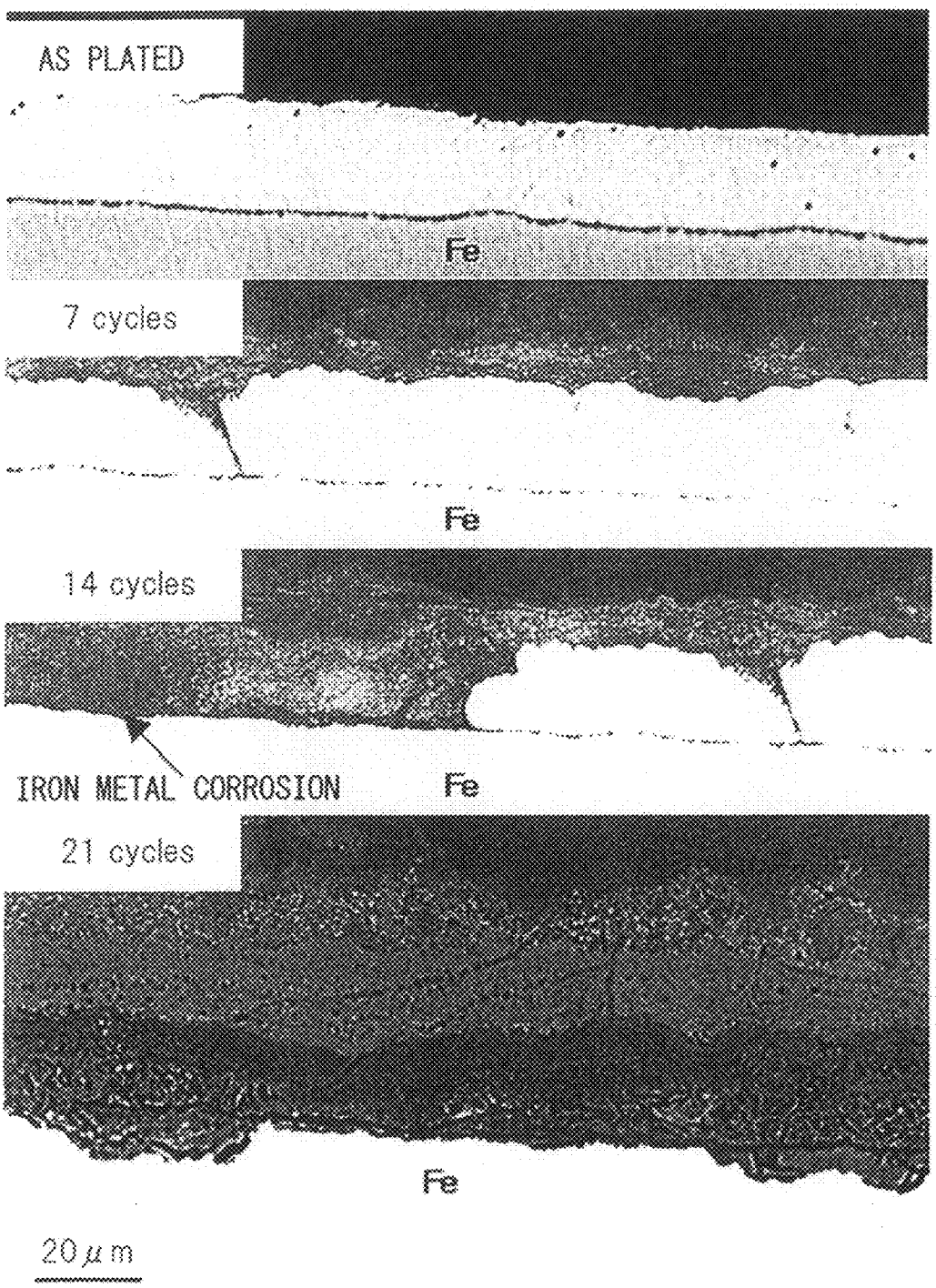
FIG. 17 is a view showing the corrosion morphology in the cross-section of the steel sheet of the Comparative Test Material 1.

FIG. 17 shows the corrosion morphology at the cross-section of the steel sheet of the Comparative Test Material 1 provided with a hot dip Zn plating layer (layer thickness: 14 μm). At 14 cycles, red rust is formed. Further, from the cross-section at 21 cycles, it is learned that after the formation of red rust, the iron metal rapidly corrodes.

Figure 18:
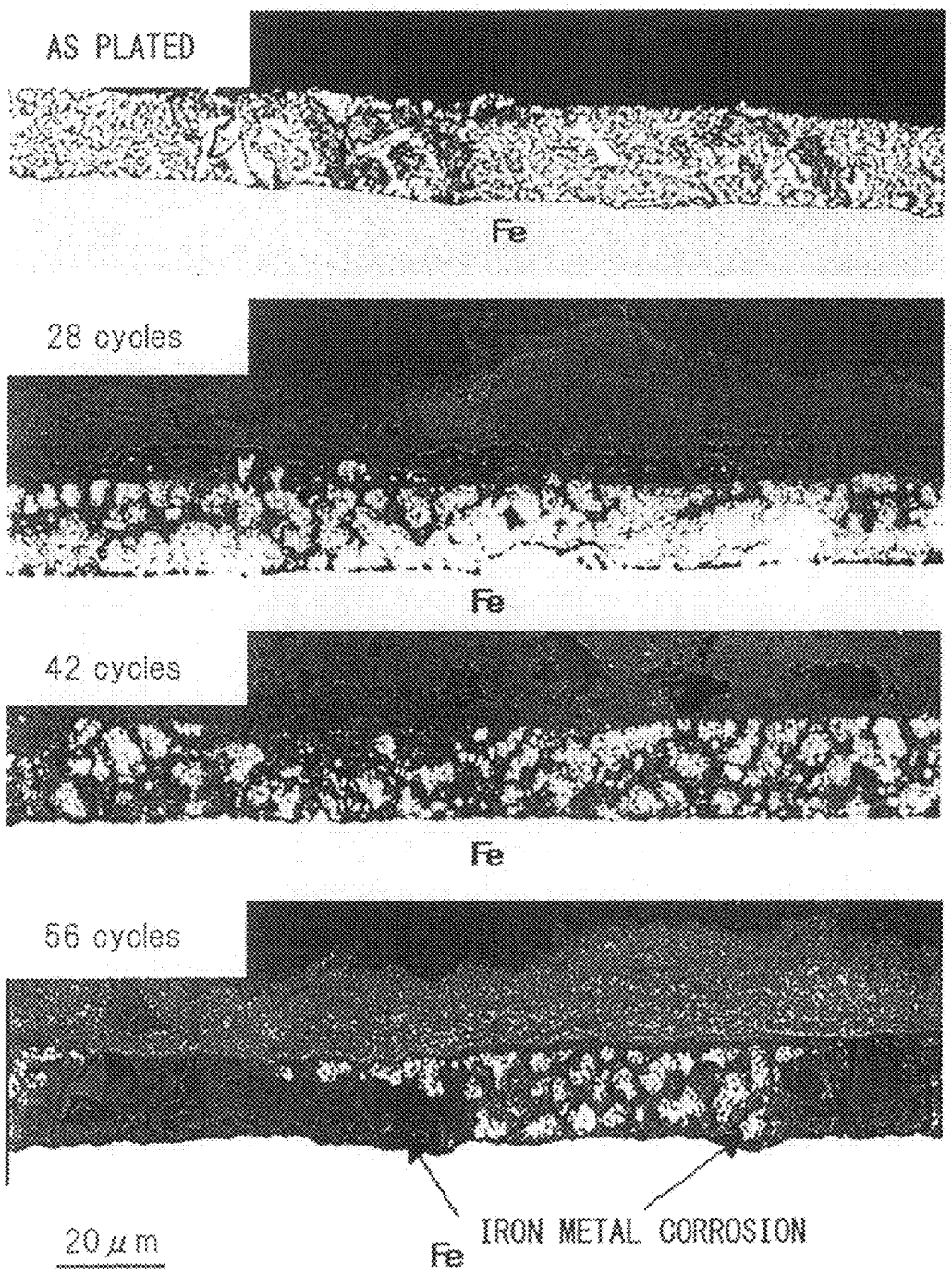
FIG. 18 is a view showing the corrosion morphology in the cross-section of the steel sheet of the Comparative Test Material 2.

FIG. 18 shows the corrosion morphology at the cross-section of the steel sheet of the Comparative Test Material 2 provided with a hot dip Zn—Al—Mg alloy plating layer (layer thickness: 12 μm). At 56 cycles, red rust is formed. The corrosion rate of the plating layer is slow, but there is little protective action of the iron metal by the corrosion products. Even if corrosion products form, the iron metal corrodes.

Figure 19:
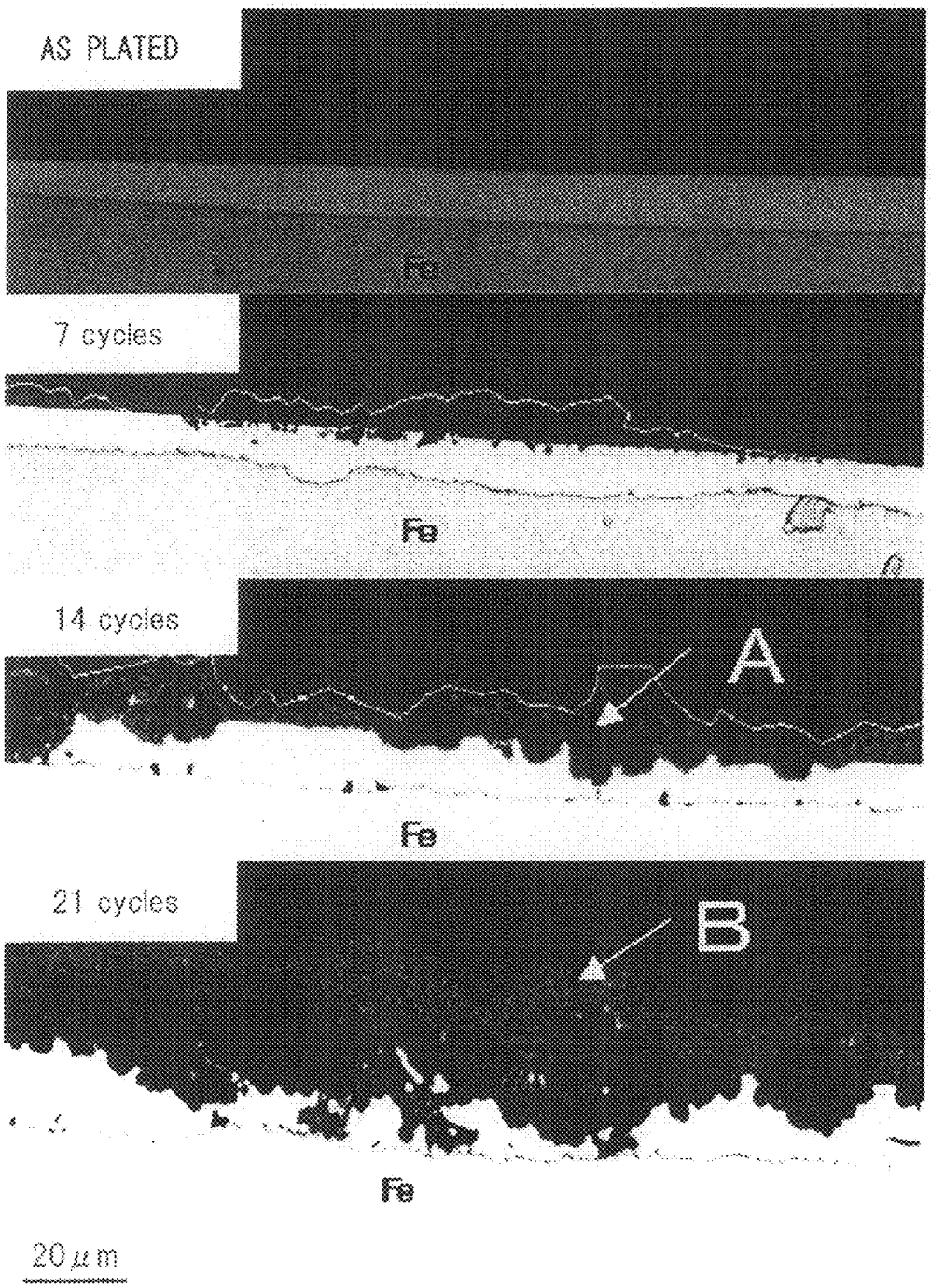
FIG. 19 is a view showing the corrosion morphology at the cross-section of the corrosion products of the Invention Test Material 1 (up to 21 cycles).
Figure 20:
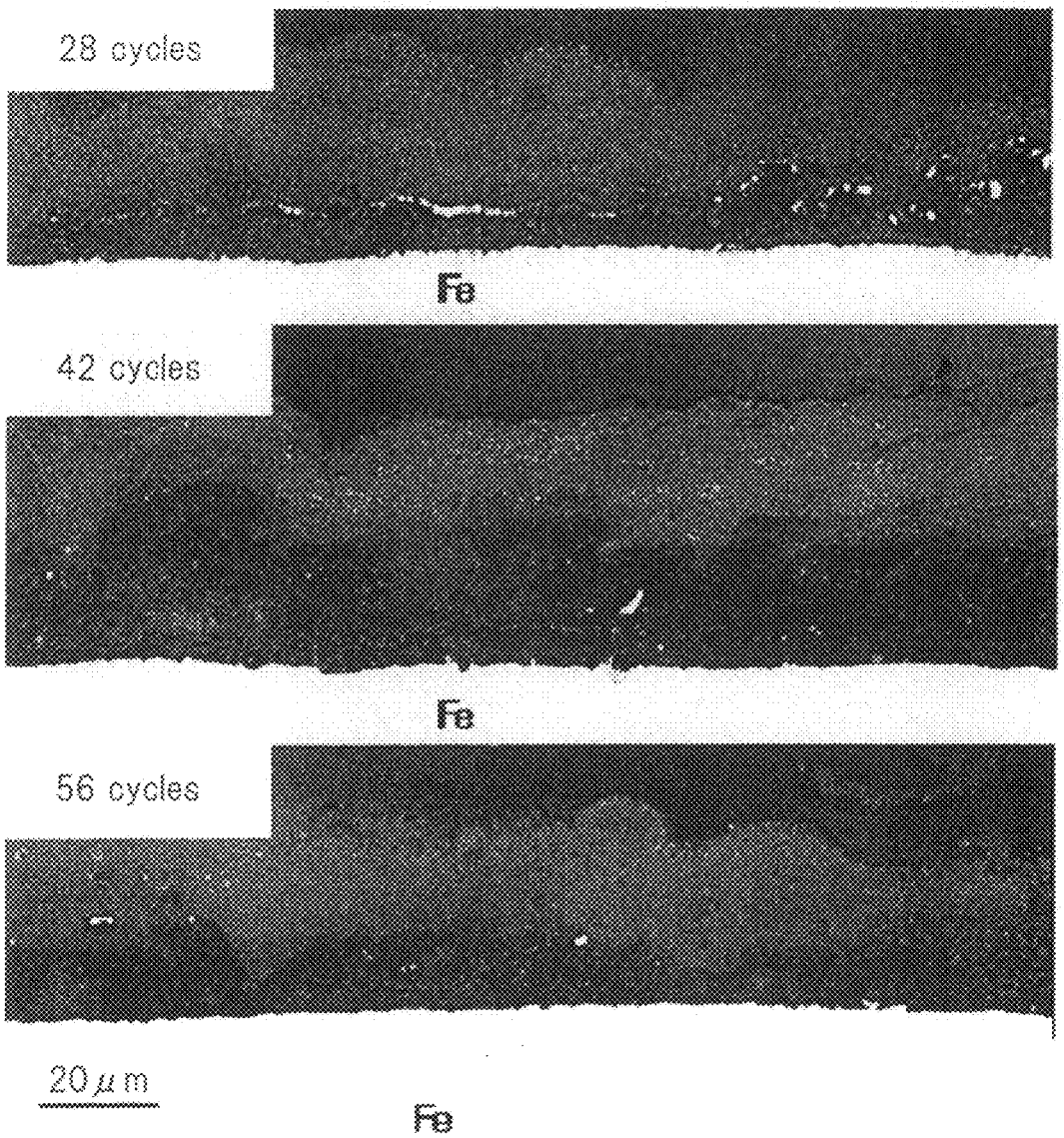
FIG. 20 is a view showing the corrosion morphology at the cross-section of the corrosion products of the Invention Test Material 1 (after 21 cycles to 56 cycles).

FIG. 19 shows the corrosion morphology up to 21 cycles at the cross-section of the steel sheet of the Invention Test Material 1 provided with a 68 atm % Mg-27 atm % Zn-5 atm % Ca alloy plating layer (amorphous, layer thickness: 10 μm), while FIG. 20 shows the corrosion morphology from 21 cycles to 56 cycles.

As shown in FIG. 19, at 14 cycles, a small amount of the corrosion products A was formed. After this, at the cross-section at 21 cycles, the corrosion products B formed little by little from the corrosion products A.

During this time, the advance of corrosion rate is fast at the amorphous phase. As shown in FIG. 20, at 28 cycles, where the corrosion products B reaches 20 μm, the plating layer ends up becoming almost completely a corrosion layer.

This does not mean that the corrosion resistance of the amorphous plating layer rapidly changes. Part of the corrosion of the plating layer reaches the steel sheet, whereby the sacrificial corrosion-proofing ability acts strongly and the corrosion rate of the plating layer is accelerated. By increasing the plating layer thickness, it is also possible to make the corrosion resistance at the start of the cycle corrosion test excellent.

However, after this, the corrosion stops. Even by 42 cycles and the next 56 cycles, the iron metal does not corrode.

When the plating layer is an amorphous layer, time is required for the formation of the corrosion products B with a high protective ability, but in the end, the corrosion products become a two-layer structure of the corrosion products A and the corrosion products B and suppresses the corrosion of the iron metal.

Figure 23:
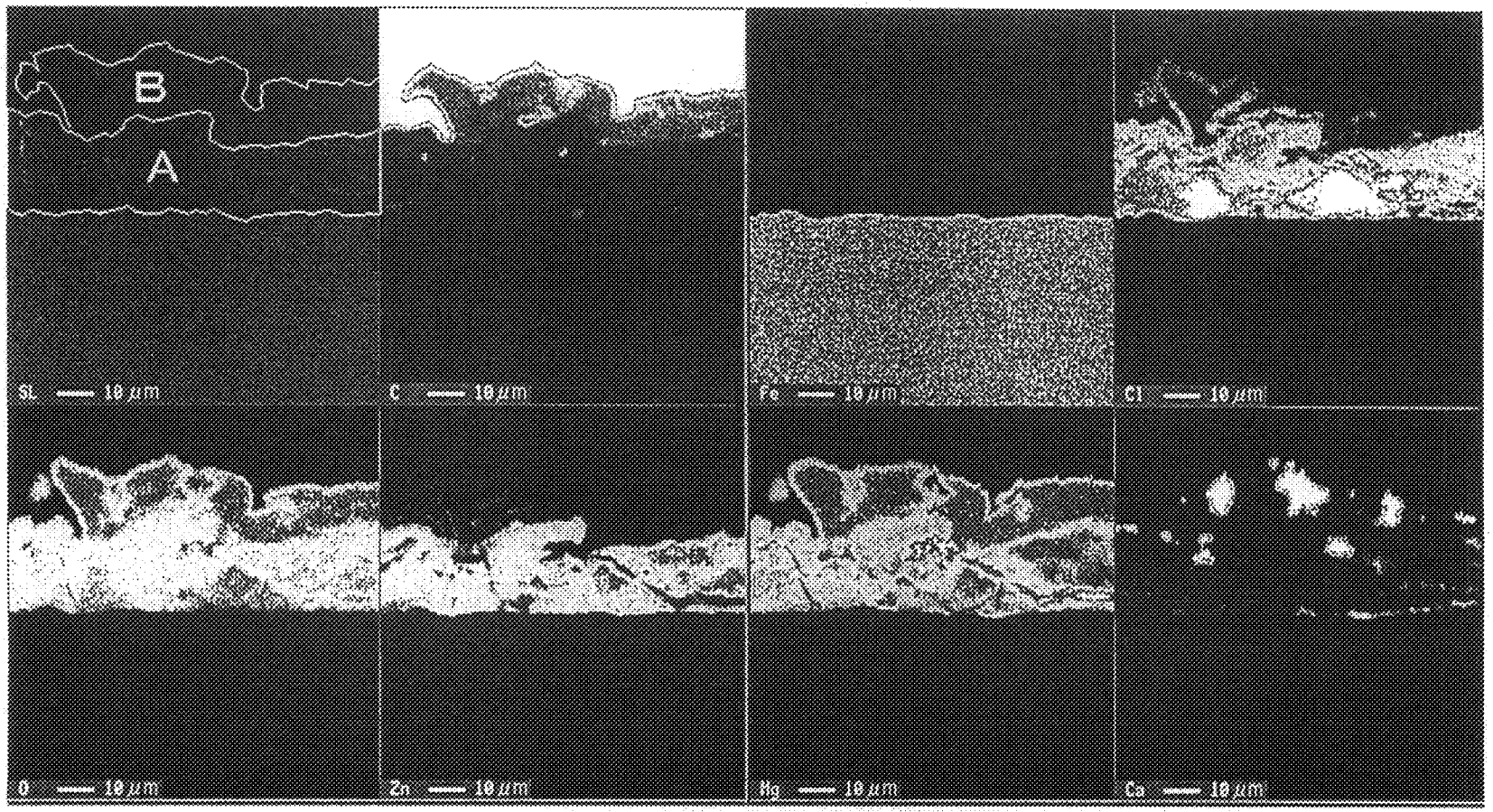
FIG. 23 is a view showing the results of examination of the cross-section of the corrosion products formed at 42 cycles of the Invention Test Material 1 by EPMA.

FIG. 23 shows the result when observing the cross-section of the corrosion products formed by 42 cycles of the Invention Test Material 1 by EPMA. At the time of 42 cycles, the plating layer of the Invention Test Material 1 becomes the two-layer state of the corrosion products A and the corrosion products B.

At the lower layer corrosion products A, the Cl concentration and O concentration are high. On the other hand, the Zn concentration, Mg concentration, and Ca concentration are average concentrations. On the other hand, at the upper layer corrosion products B, the C concentration, O concentration, and Mg concentration are extremely high.

From these results, the corrosion products A are comprised of an oxide or chloride of Zn, Mg, and Ca. On the other hand, the corrosion products B can be deduced to be comprised of Mg carbonate compounds.

Therefore, the corrosion-proofing effect of the Mg-based alloy plating can be guessed to probably be due to the Mg carbonate compounds.

Note that at the point of 42 cycles, in the plating layer, corrosion front reaches the interface between the plating layer and iron metal, but it was learned that no dissolution of Fe occurred at all.

Figure 21:
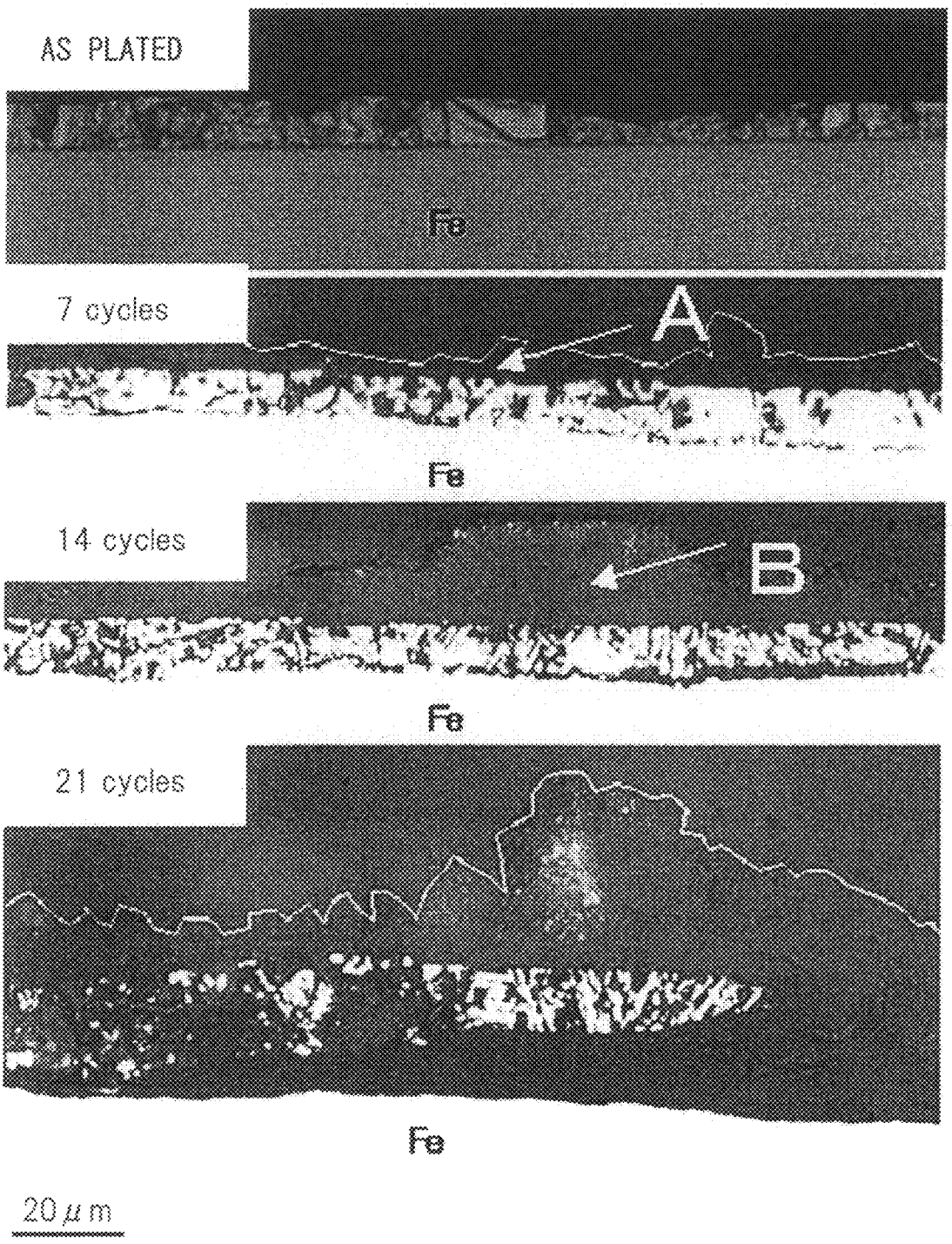
FIG. 21 is a view showing the corrosion morphology at the cross-section of the corrosion products of the Invention Test Material 2 (up to 21 cycles).
Figure 22:
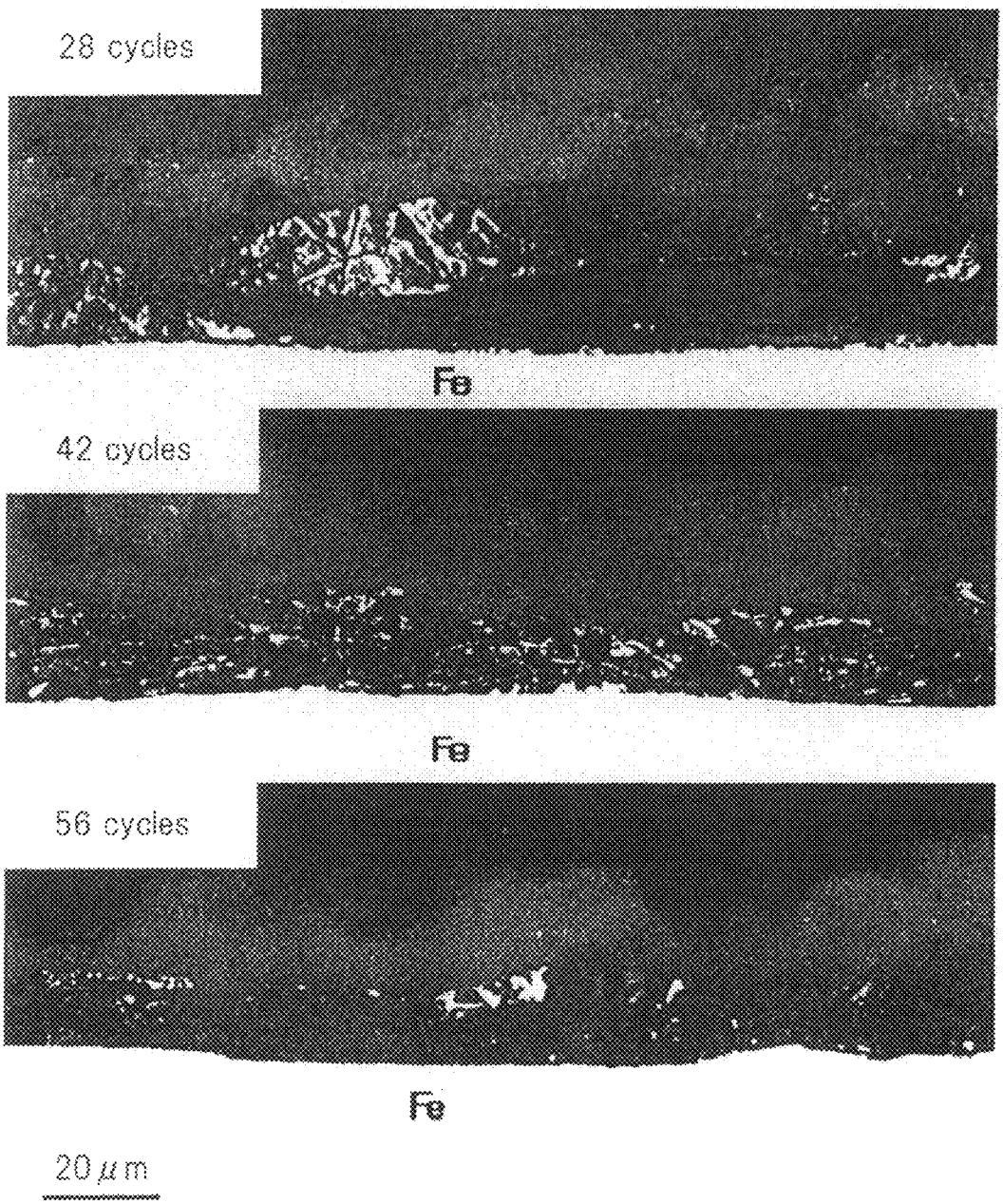
FIG. 22 is a view showing the corrosion morphology at the cross-section of the corrosion products of the Invention Test Material 2 (after 21 cycles to 56 cycles).

FIG. 21 shows the corrosion morphology up to 21 cycles in the cross-section of the steel sheet of the Invention Test Material 2 provided with a 68 atm % Mg-27 atm % Zn-5 atm % Ca alloy plating layer (crystalline, layer thickness: 10 μm), while FIG. 22 shows the corrosion morphology from after 21 cycles to 56 cycles.

When the plating layer is crystalline, at the start, the corrosion products A are formed and cover the entire plating layer surface (see 7 cycles). At this time, the loss of thickness by corrosion is about 5 μm. This corrosion rate is the same as the case of a hot dip Zn plating layer (Comparative Test Material 1).

However, the corrosion products B are immediately formed from the corrosion products A (see 14 cycles) whereby the corrosion of the plating layer and the iron metal is suppressed.

The plating layer corrodes a little at a time, but in the middle, the plating loss become equal to that of the amorphous phase layer where it takes time until the corrosion products B are form. In some cases, the corrosion loss of the crystalline plating layer may even become smaller (see 28 cycles of FIG. 22).

As shown in FIG. 22, at 42 cycles and 56 cycles, the plating layer changes almost completely to the corrosion products A, but in the same way as the amorphous plating layer, the corrosion stops and no corrosion of the iron metal occurs.

Figure 24:
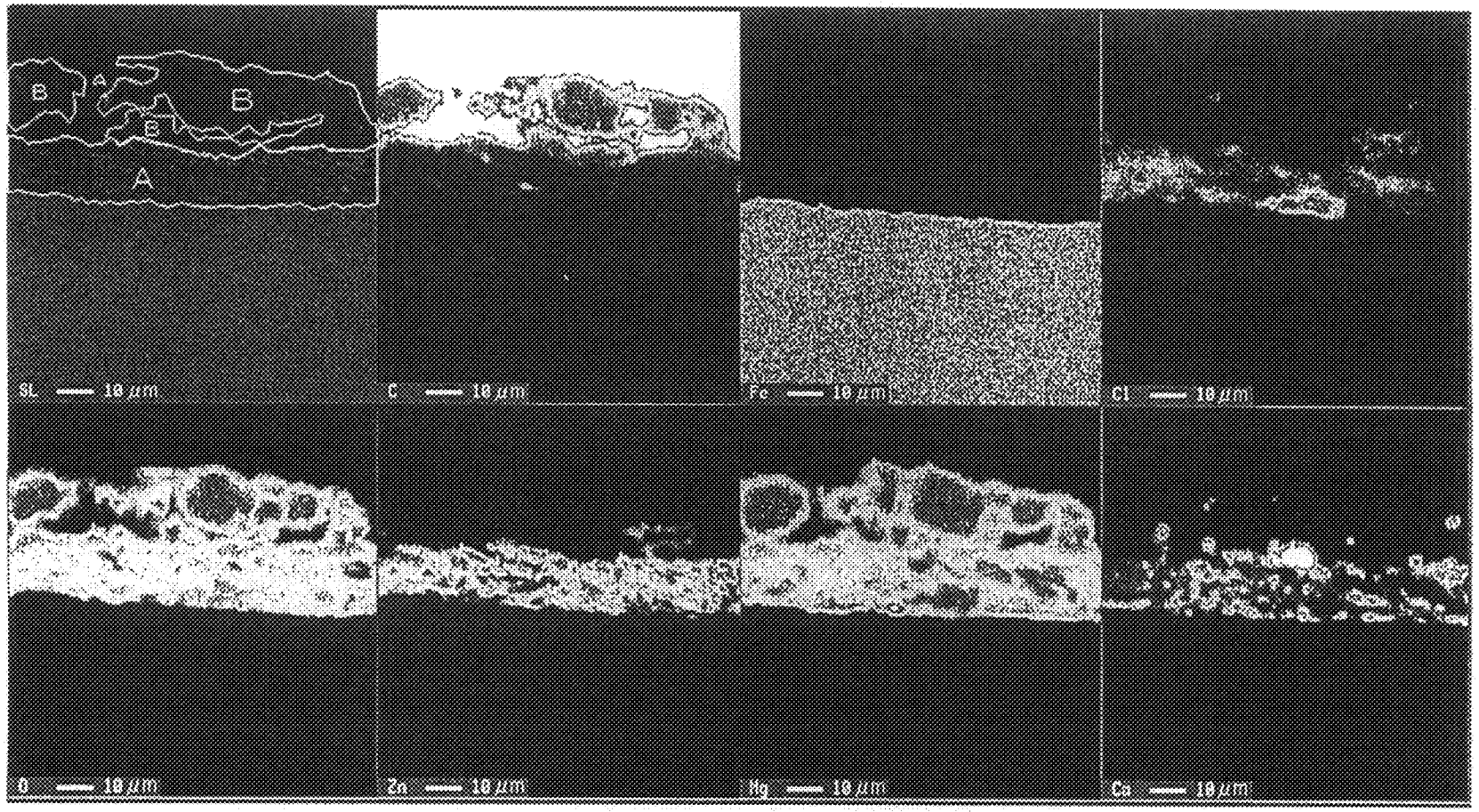
FIG. 24 is a view showing the results of examination of the cross-section of the corrosion products formed at 42 cycles of the Invention Test Material 2 by EPMA.

FIG. 24 shows the results of observation of the cross-section of the corrosion products formed by 42 cycles of the Invention Test Material 2 by EPMA. The plating layer of the Invention Test Material 2, in the same way as the plating layer of the Invention Test Material 1, is a two layer state of the corrosion products A and the corrosion products B.

From the figures, it will be understood that Cl, O, Zn, Mg, and Ca are strongly detected from the corrosion products A, and C, O, and Mg are detected from the corrosion products B.

From this, the corrosion products formed are believed to be ones similar to the corrosion products formed in Invention Test Material 1.

In the end, when the plating layer is crystalline, the highly protective corrosion products B are immediately formed at a relatively early stage, so corrosion rate is fast at the early stage, but slows in the middle stage of corrosion.

Finally, the corrosion products become a two-layer structure of the corrosion products A and the corrosion products B and suppress corrosion of the iron metal.

As explained above, the corrosion morphology in the Mg-based alloy plated steel material of the present invention actually differs from the corrosion morphology in the conventional hot dip Zn alloy plated steel material.

Next, that the reasons for limiting the composition of ingredients of the hot dip Mg-based alloy plating layer of the present invention will be explained.

To secure adhesion between the plating layer and steel material in a hot dip Mg—Zn alloy plating layer, it is necessary to make Fe diffuse in the plating layer. For this reason, it is necessary to include Zn in the hot dip plating bath. Zn has to be 15 atm % or more.

Note that below, unless the % is particularly explained, the % showing the compositions means atm %.

If Zn is less than 15%, the activity of Zn in the plating bath becomes insufficient, sufficient Fe diffusion does not occur, and sufficient adhesion cannot be obtained between the plating layer and the steel material. Due to the diffusion, sometimes the Fe is contained in the entire plating layer up to 3% or so.

However, the diffused concentration of Fe becomes higher at the interface between the plating layer and the steel sheet. When the thickness of the plating layer is small, the diffused concentration of Fe becomes higher.

Here, the 3% in the case of increasing the Fe concentration is the concentration when the thickness of the plating layer is 10 μm or so. To improve the adhesion of the plating layer, diffusion of Fe, even slight, is required, but the amount need only be 0.1% in a plating layer with a thickness of about 10 μm.

By having the Mg contain Zn in 15% to less than 45%, the melting point of Mg remarkably falls and becomes 520° C. or less. This is due to the fact that (Mg: 70%-Zn: 30%) is a binary ($Mg—MgZn_2$) eutectic composition.

The melting point of a eutectic composition is lower than the ignition point of Mg, that is, about 520° C., so even if performing Mg-based alloy plating in the atmosphere, the Mg will not ignite. For this reason, a binary ($Mg—MgZn_2$) eutectic composition is the optimum composition as a plating condition.

If Zn becomes 45% or more, the result ends up becoming far from a binary eutectic composition, the amount of production of $MgZn_2$ increases, the melting point of the plating bath rises, and the viscosity also increases. Further, if Zn is 45% or more, the melting point of the plating bath is liable to exceed the ignition point, so Zn has to be made less than 45%.

The corrosion resistance of the hot dip Mg-based alloy plating layer of the present invention is superior to the corrosion resistance of a hot dip Zn plated layer of a hot dip Zn plated steel sheet. The corrosion potential of the hot dip Mg-based alloy plating layer of the present invention is −1.0 to −1.5V (in 0.5% NaCl aqueous solution, vs. Ag/AgCl). The sacrificial corrosion-proofing ability with respect to the steel material is also remarkably superior.

That is, the hot dip Mg-based alloy plating layer of the present invention is far superior to the conventional hot dip Zn plating layer in corrosion resistance and sacrificial corrosion-proofing ability.

For the purpose of further raising the corrosion resistance of a hot dip Mg-based alloy plating, one or more elements selected from Fe, Cr, Cu, Ag, Ni, Ti, Zr, Mo, Si, and/or Nb (group of elements A) are added to the plating bath.

If these elements are added in a total of 0.03% or more, the corrosion current density near the corrosion potential of the polarization curve obtained by electrochemical measurement begins to become smaller.

If the total amount of addition of the above elements is over 5%, the melting point of the plating bath rises and plating becomes difficult, so the total amount of the elements of the group of elements A added to the plating bath is preferably 5% or less.

One or more elements selected from Al, Ca, Y, and/or La (group of elements B) also are suitably added to the plating bath to improve the corrosion resistance. If adding a total of up to 10%, the melting point and viscosity of the plating bath fall.

With addition of a total of 0.03% or more, the corrosion current density near the corrosion potential of the polarization curve obtained by electrochemical measurement begins to become smaller and the corrosion resistance of the plating layer is improved, but if the total amount of addition exceeds 15%, the melting point of the plating bath becomes higher, so the total amount of addition of the elements of the group of elements B added to the plating bath is preferably 15% or less.

Further, due to the addition of Al, Ca, Y, and/or La, the melting point and viscosity of the Mg—Zn alloy fall, so even if Zn is 45% or more, the melting point of the plating bath becomes less than the ignition point of Mg of 520° C. and there is a range of composition where Mg-based alloy plating in the atmosphere becomes possible.

Note that due to the addition of Al, Ca, Y, and/or La, the ignition point of the Mg—Zn alloy rises to about 580° C.

FIG. 1 shows the region of composition where the melting point becomes 580° C. or less due to the addition of Al, Ca, Y, and/or La. In the figure, 1 is the binary (Mg—$MgZn_2$) eutectic line and 2 is the ternary eutectic line.

If Zn is 15% or more, Mg is over 35%, and the total amount of addition of Al, Ca, Y, and/or La is 0.03 to 15%, the viscosity of the plating bath is low and the melting point becomes 580° C. or less.

Figure 2:
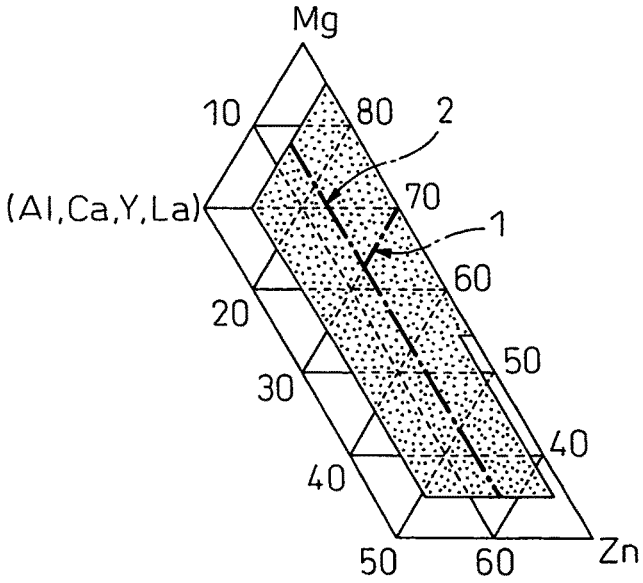
FIG. 2 is a view showing the region of composition where the melting point becomes 520° C. or less due to the addition of Al, Ca, Y. and/or La.

By further limiting the region of composition shown in FIG. 1, the melting point can be made 520° C. or less. FIG. 2 shows the region of composition where the melting point becomes 520° C. due to the addition of Al, Ca, Y, and/or La.

If Zn is 15% to less than 45%, Mg is over 35%, and the total amount of addition of Al, Ca, Y, and/or La is 0.03 to 15%, the viscosity of the plating bath is low and the melting point becomes 520° C. or less.

Even if Zn is 45% or more, if Mg is over 35% and the total amount of addition of Al, Ca, Y, and/or La is 2 to 15%, the viscosity of the plating bath is low and the melting point becomes 520° C. or less.

The total amount of addition of the elements of the group of elements B is made 0.03 to 15% since it is believed that near the element concentration of 7.5%, there is a ternary eutectic line formed by the elements of the group of elements B, Mg, and $MgZn_2$ (in FIG. 2, see "2"), and the liquid state of the Mg—Zn alloy stabilizes near this ternary eutectic composition.

For this reason, even if Zn is 45% or more and the plating is far from a binary eutectic composition, it is possible to approach a ternary eutectic line by the addition of elements of the group of elements B and the liquid state of the Mg—Zn alloy stabilizes.

However, if adding the elements of the group of elements B in a total of over 15%, the plating ends up greatly deviating from the ternary eutectic line, the melting point of the Mg—Zn alloy rises, and Mg-based alloy plating becomes difficult, so the upper limit of the total amount of addition of the elements of the group of elements B is preferably 15%.

Further, if Mg becomes 35% or less, there is soon no longer a eutectic line. Even if adjusting the amount of addition of the group of elements B, the amounts of production of $MgZn_2$, $CaZn_5$, etc. increase, the melting point of the plating bath becomes 520° C. or more, and Mg-based alloy plating becomes difficult. Therefore, the lower limit of Mg becomes over 35%.

In the case of an Mg—Zn alloy plating, if raising the cooling rate in the range of composition of Zn of 15% to less than 45%, it is possible to obtain an amorphous phase.

If the plating layer contains an amorphous phase in an amount, by volume percentage of the plating layer, of 5% or more, the corrosion resistance of the plating layer is superior to the corrosion resistance of a plating layer of the same composition, but comprising only a crystal phase.

If the amorphous phase is present in the plating layer, the corrosion potential becomes more noble compared with the corrosion potential of a plating layer of the same composition, but comprising only a crystal phase.

If the plating layer contains an amorphous phase in 5 vol % or more, the corrosion potential rises by 0.01V or more compared with the corrosion potential of a plating layer of the same composition, but comprising only a crystal phase. Further, the corrosion current density at the corrosion potential also becomes smaller.

The corrosion resistance in an actual environment can be evaluated by a cycle corrosion test. A plating layer containing an amorphous phase in an amount of 5 vol % or more as a result of the evaluation has less of a corrosion loss at the start of a cycle corrosion test than a plating layer of the same composition, but comprising only a crystal phase.

If the plating layer contains an amorphous phase in an amount, by volume percentage, of less than 5%, the plating layer exhibits a corrosion resistance equal to that of a plating layer of the same composition, but comprising only a crystal phase (plating layer cooled by nitrogen gas after plating).

The rise of the corrosion potential is less than 0.01V, the corrosion current density also becomes substantially equal, and no clear change in characteristics can be seen. The evaluation of the corrosion resistance by a cycle corrosion test was similar.

The reasons why the corrosion resistance is improved if the plating layer contains an amorphous phase are not clear, but it is believed that (a) the amorphous phase is a homogeneous structure with neither crystal grain boundaries where the elements segregate nor intermetallic compounds, (b) elements improving the corrosion resistance can be dissolved in the matrix phase up to the solution limit, and (c) an amorphous phase is a nonequilibrium phase, so the surface is activated and a dense oxide film is rapidly formed.

Furthermore, when forming a plating layer containing an amorphous phase, if adding Ca, Y, and/or La (group of elements B'), the amorphous phase forming ability derived from the composition of the plating layer is improved.

If adding elements of the group of elements B' raising the amorphous phase forming ability to the plating bath, it is possible to form a hot dip Mg-based alloy plating layer containing an amorphous phase on a steel sheet easily.

The group of elements B' feature giant atoms compared with Zn and Mg. To raise the amorphous phase forming ability, it is sufficient that atoms which would inhibit movement of atoms at the time of solidification are included in the alloy so that the liquid state becomes as stable as possible.

As such atoms, in addition to Ca, Y, and La, Ce, Yb, and other relatively large atom size lanthanide elements may be mentioned. These elements are considered to exhibit actions and effects similar to the group of elements B.

Addition of Al is effective for improvement of the corrosion resistance, but has no action in improving the amorphous phase forming ability.

This is believed to be because the enthalpy of formation of liquid of Al with Zn is positive and Al is an element with properties different from the Ca, Y, and/or La with negative liquid enthalpy with Zn.

The compositions giving an amorphous phase in a hot dip Mg-based alloy plating layer are limited.

Figure 3:
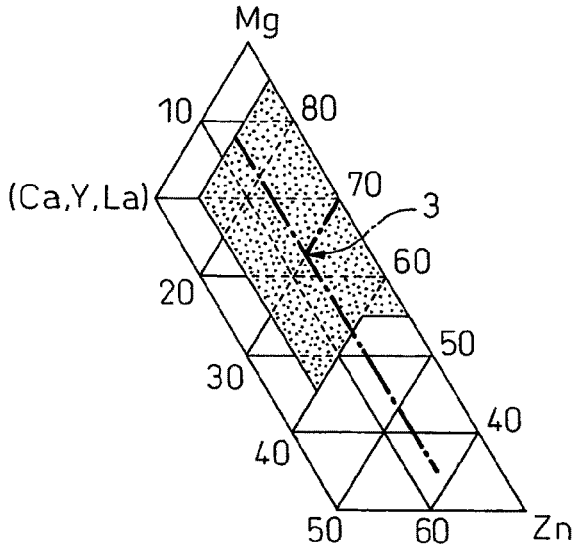
FIG. 3 is a view showing the region of composition where an amorphous phase is obtained.

FIG. 3 shows a region of composition giving an amorphous phase. A composition giving an amorphous phase is limited to specific compositions due to the difference between the melting point and glass transition temperature of the Mg-based alloy.

Even if the composition of ingredients changes, the glass transition temperature will not change that much, so an amorphous phase is usually easily formed the lower the melting point. Therefore, the amorphous phase forming ability is closely related to the eutectic composition.

A eutectic composition Mg-based alloy has a low melting point, so is a composition most easily maintaining its liquid state down to the glass transition temperature.

In a composition comprised of elements selected from Mg, Zn, and the group of elements B', the eutectic line cross point 3 (see "3" in FIG. 3) where the binary (Mg—$MgZn_2$) eutectic line and the ternary eutectic line cross is the lowest in melting point. In the region of composition near this cross point, the amorphous phase forming ability becomes extremely high.

If Mg becomes 55% or less in a hot dip Mg-based alloy plating layer containing elements of the group of elements B' in a total of less than 5%, the plating becomes far from a eutectic composition, the melting point rises, and the amorphous phase forming ability becomes smaller.

As a result, it becomes difficult to form an amorphous phase in a plating layer by a plating process using water cooling, so when forming an amorphous phase, Mg is made over 55%.

In the same way, if Zn becomes 40% or more in an alloy plating layer containing elements of the group of elements B' in a total of 5% or more, the plating becomes far from a eutectic composition, the melting point rises, and the amorphous phase forming ability becomes smaller.

As a result, it becomes difficult to form an amorphous phase in a plating layer by a plating process using water cooling, so when forming an amorphous phase, Zn is made less than 40%.

In a range of composition of Zn: less than 40% and Mg: over 55%, the melting point becomes a remarkably low 450° C. or less, so this range of composition is the range of composition convenient for obtaining an amorphous phase.

Further, by including an amorphous phase in a hot dip Mg-based alloy plating layer containing elements of the group of elements A, it is possible to further improve the corrosion resistance.

Utilizing the effect of improvement of the corrosion resistance due to the addition of corrosion resistance improving elements and formation of an amorphous phase, it is possible to produce steel sheet provided with a hot dip Mg-based alloy plating layer remarkably superior in corrosion resistance.

The hot dip Mg-based alloy plating layer of the present invention and the hot dip Mg-based alloy plating layer containing an amorphous phase are plating layers superior in both workability and adhesion. An Mg—Zn alloy is an alloy with extremely slow crystallization and grain growth.

For this reason, in the plating layer, by just slightly raising the cooling rate, the crystal grains easily become finer, so it is possible to reduce the detrimental effect of intermetallic compounds poor in plastic deformability on the workability and adhesion.

If it is possible to obtain an amorphous phase having an atomic structure of a liquid state, the intermetallic compounds are eliminated, so the workability and adhesion can be further improved.

In hot dip Mg—Zn alloy plating, in addition to the technique of forming an amorphous phase in the plating layer, it is possible to strikingly improve the corrosion resistance by the presence of an intermetallic compound phase of $Zn_3Mg_7$.

Figure 4:
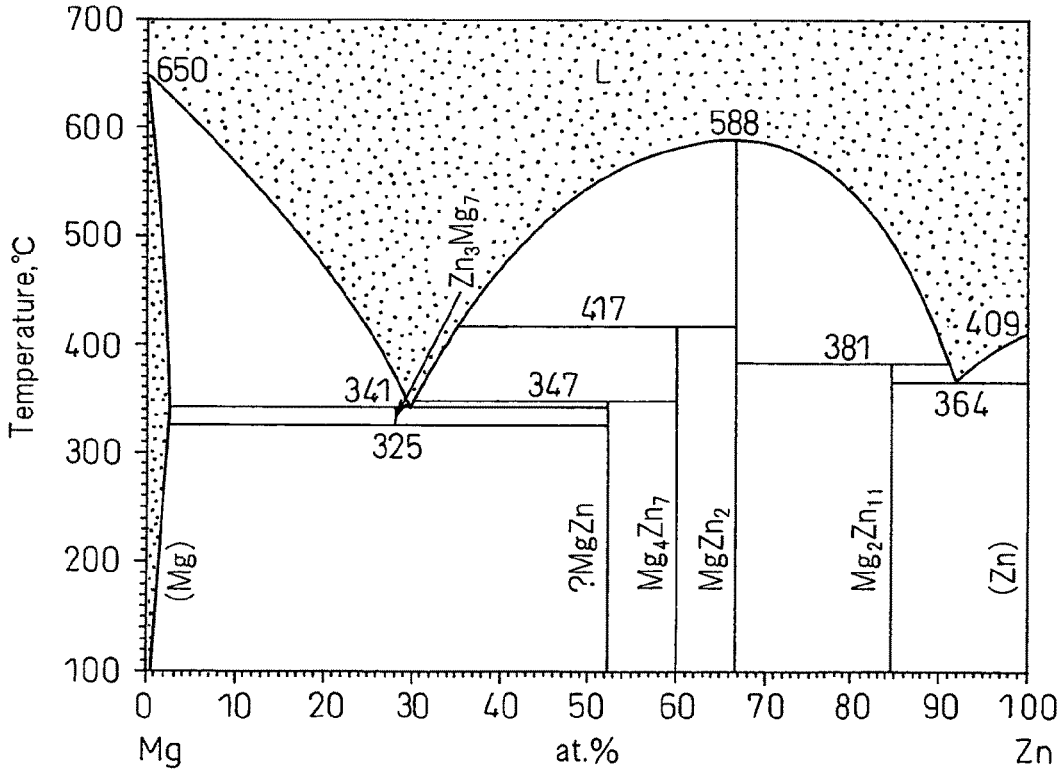
FIG. 4 is a view showing a binary alloy phase diagram of Mg—Zn.

$Zn_3Mg_7$ ($Zn_3Mg_7$ is expressed as $Mg_{51}Zn_{20}$ in some papers, but in the present description the two intermetallic compounds are treated as the same substances and are all expressed as $Zn_3Mg_7$) is a high temperature stable phase as shown in FIG. 4.

For this reason, if applying slow cooling as in an ordinary hot dip plating process, the Mg and Zn in the molten state separate into an Mg phase and MgZn or $Mg_4Zn_7$. It is not possible to leave $Zn_3Mg_7$ at an ordinary temperature.

However, in the same way as forming an amorphous phase, it is possible to leave $Zn_3Mg_7$ by rapid cooling (for example, water cooling or mist cooling) right after hot dip plating.

$Zn_3Mg_7$ can be formed even in a composition with a small amorphous phase forming ability, that is, Mg—Zn alloy plating or Mg—Zn—Al alloy plating.

In a composition with a high Ca concentration in an Mg—Zn—Al—Ca alloy plating, if water cooling after hot dip plating, sometimes an amorphous phase and $Zn_3Mg_7$ are mixed in a plating layer.

Figure 5:
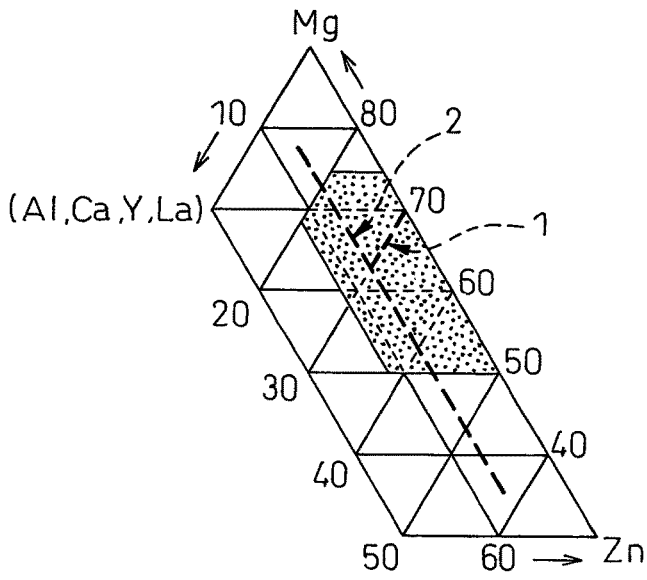
FIG. 5 is a view showing the region of composition where $Zn_3Mg_7$ is obtained.

FIG. 5 shows the range of composition by which $Zn_3Mg_7$ is obtained by hot dip plating, then water cooling. The range of composition shown in FIG. 5 is the range of composition where $Zn_3Mg_7$ can be easily detected as the XRD peak by X-ray diffraction of the plated steel sheet surface.

This range of composition is the range of composition where the X-ray intensity ratio (ratio of diffraction peak intensity of $Zn_3Mg_7$ (excluding diffraction peak of diffraction plane spacing of 0.233 nm) in the sum of all diffraction peak intensities appearing at diffraction plane spacings of 0.1089 to 1.766 nm, that is, diffraction angles 2θ of 5 to 90° in case of diffraction measurement by Cu—Kα rays using an X-ray tube with Cu target for the X-ray source (however, excluding diffraction peak of diffraction plane spacing of 0.233 nm)) is 10% or more.

The diffraction peak of a diffraction plane spacing of 0.233 nm is preferably excluded since the strongest line of Mg and the diffraction peak are close. Note that the diffraction peak of $Zn_3Mg_7$ is found by referring to the diffraction data charts (JCPDS card no.: 08-0269).

To form $Zn_3Mg_7$, it is necessary that Zn be 20% or more, Mg be 50% to 75%, and the one or more elements selected from the group of elements B: Al, Ca, Y, and La be a total of 0.03 to 12%. In the range of composition where the Ca concentration or Y and La concentration is high and the amorphous phase forming ability is high, sometimes an amorphous phase is formed and $Zn_3Mg_7$ cannot be obtained.

In particular, when using water cooling (water immersion) as a rapid cooling method, only a certain cooling rate can be obtained, so obtaining a $Zn_3Mg_7$ phase is difficult. Even with a composition where an amorphous phase is generally obtained, by changing the rapid cooling method from water cooling (for example, to mist cooling etc.) so as to reduce the cooling rate given to the plating layer, it is possible to partially obtain a $Zn_3Mg_7$ phase. Below, unless otherwise indicated, the case of use of water cooling as the rapid cooling method is assumed.

Therefore, when Ca, Y, and/or La exceed a total of 1%, it is necessary to add Al: 1% or more and prevent the amorphous phase forming ability from being raised too much.

Al is an element promoting the formation of $Zn_3Mg_7$ more than the amorphous phase, so if the Al concentration is higher than the Ca concentration, $Zn_3Mg_7$ is more easily formed than the amorphous phase.

When Ca, Y, and/or La are a total of not more than 1%, formation of a small amount of amorphous phase and formation of $Zn_3Mg_7$ occur simultaneously.

If $Zn_3Mg_7$ is contained in the plating layer, the corrosion potential of the plating layer becomes about −1.2V (vs. Ag/AgCl) in a 0.5% NaCl aqueous solution.

This value is a high value compared with the corrosion potential of −1.5 to −1.4V of a plating layer of the same composition but not containing $Zn_3Mg_7$ (plating layer air cooled after plating). The greater the amount of $Zn_3Mg_7$ in the plating layer, the closer the corrosion potential to −1.2V. The corrosion current density near the corrosion potential of the polarization curve starts to become smaller.

Even in a plating layer where $Zn_3Mg_7$ is detected by X-ray diffraction, if Al or Ca is added in the plating layer, the corrosion current density becomes small. With Al of 0 to 6% or so, if the concentration increases, the corrosion current density becomes smaller. If adding Ca: 0.3 to 5%, the corrosion current density becomes smaller.

When desiring to make $Zn_3Mg_7$ precipitate preferentially over the amorphous phase, Al is added in a greater amount than Ca.

$Zn_3Mg_7$ remarkably raises the corrosion resistance of the plating layer, but if present in a large amount in the plating layer, the workability of the plating layer degrades and cracking easily occurs.

On the other hand, an amorphous phase does not have as much of an effect of improvement of the corrosion resistance as $Zn_3Mg_7$, but is homogeneous, so is superior in workability, is superior in surface flatness, and has many other advantages. If desiring to particularly impart corrosion resistance to an amorphous phase plating layer, it is sufficient to mix $Zn_3Mg_7$ in the plating layer.

A plating layer containing $Zn_3Mg_7$ has a superior sacrificial corrosion-proofing ability with respect to steel sheet compared with a 55% Al—Zn plating, Al-10% Si plating, etc.

To measure the sacrificial corrosion-proofing ability, it is sufficient to bend the hot dip plated steel sheet and find the corrosion resistance of the worked part by a salt water spray test or cycle corrosion test. If an alloy plated steel sheet, the plating layer of the worked part cracks, so part of the steel sheet becomes exposed.

A 55% Al—Zn plated steel sheet, Al-10% Si plated steel sheet, etc. with a low sacrificial corrosion-proofing ability have red rust formed at the worked part immediately after the start of the test, but in hot dip Mg—Zn plated steel sheet, the exposed part of the steel sheet of the worked part is immediately covered by Mg oxides, so the formation of red rust is greatly delayed.

An Mg—Zn amorphous plated steel material, Mg—Zn amorphous-phase containing plated steel material, and $Zn_3Mg_7$-containing plated steel material all are hot dip Mg-based alloy plated steel materials having nonequilibrium phases, so during the process of production, require at least water cooling, high pressure mist cooling, or other cooling with a relatively large effect of cooling.

In particular, a large cooling rate is required for increasing the amount of the nonequilibrium phase superior in corrosion resistance.

Here, in actuality, there are at least two problems when producing a nonequilibrium phase Mg—Zn hot dip plated steel material.

One is that when introducing a cooling facility with a large cooling effect in a plating process, setting a cooling facility with a high cooling ability right after hot dip plating handling a high temperature hot dip plating metal leads to a rise in costs.

The inventors studied the series of heat processes of reheating and rapidly cooling a plating layer (hereinafter referred to as "reheating/rapid cooling") for the purpose of increasing the amount of the nonequilibrium phase contained in the plating layer using an equilibrium phase hot dip Mg—Zn alloy plating as a starting point.

As a result, the inventors discovered that when Mg, Zn, and Ca are in a specific range of composition and applying reheating/rapid cooling of specific conditions to a plating layer, the alloying of the Zn in the plating layer and the Fe supplied from the steel material is suppressed.

Usually, if holding a plating layer containing Zn at 400° C. or more, the Zn in the plating layer and the Fe supplied from the steel material react to form a Γ-phase, δ-phase, or other intermetallic compound phase (that is, alloying occurs).

Hot dip galvannealed steel sheet (GA), widely used in the automobile field, is Zn—Fe plated steel sheet deliberately utilizing this metallurgical phenomenon to improve the weldability and the corrosion resistance after painting.

However, Mg and Ca are elements poor in reactivity with Fe and lower the activity of Fe and Zn, so if Mg and/or Ca is present in the plating alloy in a certain concentration or more, intermetallic compounds of Zn and Fe are hard to form during hot dip plating. Further, even if melting again after plating, intermetallic compounds of Zn and Fe are hard to form.

The range of composition enabling suppression of this alloying should be in the range of composition shown in FIG. 1. That is, it is possible to suppress alloying if a Mg—Zn hot dip plating layer containing Zn: 15% or more, Mg: 35% or more, and Ca: 15% or less.

Of course, when in the range of composition shown in FIG. 1, but outside the range of composition shown in FIG. 3 or FIG. 5, even in a region of composition where a nonequilibrium phase is not much obtained, it is possible to confirm that the amount of the nonequilibrium phase rises, though slightly, by confirming by DSC that the amount of exothermic peaks due to the increasing of the amount of the nonequilibrium.

Alloying can be suppressed when heating the alloy plated steel material from a temperature near the melting point of the plating bath (melting point in range of composition shown in FIG. 1 of 580° C. or less), that is, the melting point, to a temperature within (melting point+100° C.) and holding it in a short time (about 1 minute).

When holding an alloy plated steel material for a long period at a temperature near the melting point of the plating bath or when heating to a much higher temperature than the melting point, even if the composition of the plating layer is a composition in the range of compositions shown in FIG. 1, alloying of Zn and Fe can occur.

Even if making the plating layer thick, sometimes some Fe—Zn intermetallic compounds are formed near the interface between the plating layer and steel sheet, but the Fe—Zn intermetallic compounds will never grow and alloying will never progress during the heating and rise in temperature of the alloy plated steel sheet.

The Fe required for securing the adhesion of the plating layer is a fine amount of about 0.1% or so. Further, the Fe which can be contained in the plating layer as a whole is about 3%, but this extent of amount of Fe almost never leads to alloying with Zn.

Alloying of Fe and Zn remarkably progresses when 10% or so of Fe is contained in the plating layer. Under heat treatment heating from the melting point of the plating bath to a temperature within the (melting point+100° C.) and holding there for a short time (about 1 minute), the activity of Fe in the Mg falls and alloying of Fe and Zn does not occur.

The alloying of Fe and Zn is confirmed by detecting intermetallic compounds using X-ray diffraction through the plating layer, or by detecting intermetallic compounds using a scanning electron microscope with an energy dispersive X-ray spectrometer (SEM-EDX) at the cross-section of the plating layer, etc.

Usually, a Zn—Fe alloy layer grows from the interface, so it is possible to use an optical microscope to examine the plating layer-steel sheet interface so as to easily confirm the existence of a Zn—Fe alloy layer.

To confirm the suppression of Zn and Fe alloy, it is effective to investigate the ingredients of the plating layer before and after reheating. Usually, if the Fe contained in the plating layer is less than 0.5%, Zn—Fe intermetallic compounds will almost never be observed.

If Fe becomes 0.5% or more, some Fe—Zn intermetallic compounds will be produced near the interface of the plating layer and steel sheet, but if reheating to a suitable temperature, the intermetallic compounds will not grow during the rise in temperature and alloying will not progress.

The ingredients in the plating layer may be analyzed by preparing about 50 ml of a plating layer dissolving solution by 10% hydrochloric acid etc. plus an inhibitor, using this plating layer dissolving solution to pickle only the plating layer, and analyzing the ingredients in the dissolving solution after pickling by an ICP mass spectrometry apparatus.

The advantage of reheating/rapid cooling lies in increasing the amount of the nonequilibrium phase in addition to the independence of the rapid cooling process. When producing a steel material provided with a Mg—Zn hot dip plating layer containing a nonequilibrium phase, it is necessary to gas wipe the surface after plating to adjust the plating layer to the target thickness, then rapidly cool it.

At the time of gas wiping performed right after plating, if the drop in temperature of the plating layer is large, the plating layer crystallizes before the rapid cooling and, after the rapid cooling, no nonequilibrium phase of the amorphous phase is produced and the plating layer ends up becoming the same as the plating layer produced under equilibrium conditions.

To obtain an amorphous phase or other nonequilibrium phase, it is important to cool the plating layer by a sufficiently large cooling rate from a temperature right above the melting point of the plating bath.

The temperature of the plating bath is usually set to a temperature 10 to 100° C. higher than the melting point of the plating alloy for the purpose of improving the adhesion of the plating layer and steel material, holding the plating bath stable, etc.

However, making the temperature of the plating bath further higher for the above purpose is not preferable in terms of costs. Further, problems such as the increase of the production of dross and ignition of Mg characteristic of Mg-based alloy platings are also caused.

If the temperature of the plating bath becomes further higher, the steel material temperature rises and the cooling rate at the time of cooling falls. In particular, when using water cooling for cooling, the amount of production of steam due to the heat capacity of the steel material increases, the cooling rate further falls, and the amount of the nonequilibrium phase becomes smaller.

However, with the hot dip Mg—Zn plating layer of the present invention, even if the amount of the nonequilibrium phase is small, it is possible to use-reheating to heat to right above the melting point of the plating bath, melt the plating layer again one time to eliminate the crystal phase or equilibrium phase, then rapidly cool it to cause the formation of an amorphous phase or other nonequilibrium phase so as to increase the amount of the nonequilibrium phase.

That is, if a hot dip Mg-based alloy plating layer of the range of composition of the present invention, it is possible to suppress alloying of Zn and Fe, so it is possible to reheat/rapidly cool the plating layer without alloying.

The reheating/rapid cooling is cooling for rapidly cooling from the temperature right above the melting point of the plating bath, so it is possible to cool down to the glass transition temperature in a short time. This is a cooling pattern suitable for obtaining an amorphous hot dip plated steel material.

Note that the conditions at the time of reheating govern the progress of alloying between Zn and Fe. If the reheating temperature is too high or the holding time is long—even at a temperature immediately above the melting point of the plating bath, even plating of the range of composition of the present invention may alloy.

The inventors studied the reheating conditions and as a result learned that a temperature 10 to 100° C. higher than the melting point of the plating bath is suitable as the holding temperature and that the holding time is preferably within 1 minute.

Further, to suppress alloying of Fe and Zn, it is preferable to hold the plating layer at 500° C. or less.

When this condition is not met, that is, when excessively raising the temperature, the diffusion of Fe is unnecessarily activated and alloying is facilitated. The rate of temperature rise at the time of reheating is not particularly limited, but the rate of temperature rise is preferably slow so as to make the temperature of the plating layer as a whole constant and further to prevent overheating due to a rapid temperature rise.

In the hot dip Mg—Zn alloy plating layer, it is difficult to secure adhesion between the plating layer and steel sheet due to the poor reactivity of Mg and Fe.

In particular, when the Mg concentration is high, "non-plating defects" easily occur. Securing adhesion with the steel sheet also becomes more difficult, but it is possible to use the preplating method to suppress "non-plating defects" and easily secure adhesion with the steel sheet.

A preplating layer must have "wettability" with the plating alloy. The inventors investigated the wettability with an Mg-based plating alloy for various alloy elements for securing adhesion between the plating layer and steel sheet.

As a result, it was learned that Cr, Co, Ni, Cu, Ag, and/or Sn are suitable as preplating metal. The preplating layer may also be a plating layer of an alloy combining a selection of two or more of these metals.

This metal preplating layer is preferably formed by electroplating or electroless plating. The thickness of the preplating layer should be 0.1 to 1 μm (deposition amount of 1 to 10 $g/m^2$).

After plating by ordinary Mg—Zn hot dip plating conditions (bath temperature of 350 to 600° C.), the preplating layer sometimes remains.

If the preplating layer is too thin, the effect of suppression of non-plating defects and the effect of securing adhesion cannot be expected.

After the plating, the elements forming the preplating layer diffuse inside the plating layer and are included in the plating layer in amounts of 1% or so. The amounts of elements diffused from the preplating layer are very small and form a substitution type solid solution in the plating layer.

The "non-plating defects" can be easily confirmed visually. The number of the "non-plating defects" present in a certain range from the center of the plated steel sheet is confirmed visually and the extent of "non-plating defects" judged by the number per unit area.

Note that the number of the "non-plating defects" of the steel sheet surface changes with the immersion speed of the steel sheet in the plating bath, so when confirming the effect of the preplating, it is preferable to make the immersion speed of the steel sheet in the plating bath constant.

The material of the steel material forming the substrate of the present invention steel material is not particularly limited. Al-killed steel, ultralow carbon steel, high carbon steel, various high-tensile steel, Ni steel, Cr steel, Ni—Cr steel, etc. can be used.

The steelmaking method, strength of the steel, hot rolling method, pickling method, cold rolling method, etc. are also not particularly limited.

For the plating method, the Sendimir method; preplating method, two-step hot dipping method, flux method, etc. may be used. As the preplating before the Mg—Zn alloy plating of the present invention, Ni plating, Sn—Zn plating, etc. may be used.

The steel material provided with an Mg—Zn alloy plating layer of the present invention is preferably produced by a vacuum or inert gas atmosphere. As the preplating before the Mg—Zn alloy plating of the present invention and the first step dipping in two-step hot dipping, Ni plating, Zn plating, Sn—Zn plating, etc. may be used.

The alloy used for the plating bath may be produced in advance without worrying about the ignition point of Mg if melting Mg and Zn mixed in a predetermined ratio in a "crucible" with an inside replaced with an inert gas etc.

There is also the method of utilizing commercially available non-combustible Mg. In this case, it is sufficient to mix predetermined amounts of the non-combustible Mg and Zn and melt them near 600° C. However, non-combustible Mg sometimes contains Al or Ca. In this case, the plating bath will also contain Al or Ca.

By having the plating bath contain Mg in a high concentration, it is possible to suppress the formation of a Zn—Fe alloy layer. For this reason, it is not necessary to add Al to the plating bath for the purpose of suppressing formation of a Zn—Fe alloy layer.

The formation of a Zn—Fe alloy layer with poor plastic deformability also causes powdering, flaking, and other peeling of the plating layer due to working after plating. An Mg-based alloy plating layer containing Mg in a high concentration of the present invention has the advantage of not causing peeling of the plating layer.

Regarding the addition of Fe, Cr, Cu, Ag, Ni, Ti, Zr, Mo, Si, and/or Nb, if adding small amounts of up to a total of around 0.1%, it is possible to introduce them into the plating bath by adding metal powders to the plating bath and holding the bath there in an inert atmosphere at around 600° C. for a long period of time.

When adding the above metals in a high concentration, an atmospheric furnace etc. is used to prepare an alloy of the added metals and Zn or Mg and this alloy is added to the plating bath. In the preparation of this added alloy as well, since Zn has a low boiling point, it is preferably melted at 900° C. or less.

Regarding the addition of Al, Ca, Y, and/or La, if adding them up to a total of around 5%, it is possible to introduce them into the plating bath by adding metal powders to the plating bath and holding the bath there in an inert atmosphere at around 600° C. for a long period of time.

When adding the above metals over 5%, an atmospheric furnace etc is used to prepare an alloy of the added metals and Zn or Mg and this alloy is added to the plating bath.

If an Mg—Zn alloy plating where Ca, Y, La, etc. are added to raise the amorphous phase forming ability, it is possible to easily obtain a single phase of an amorphous phase by hot dip plating, then cooling the plating layer by for example mist cooling etc. from a close distance where a cooling rate of about 10 to 1000° C./sec is obtained at the surface layer of the plating.

In another Mg—Zn system where Ca, Y, La, etc. are not added and the amorphous phase forming ability is small, it is possible to obtain a cooling rate of about 1000 to 5000° C./sec at the surface layer of the plating and to produce an amorphous hot dip plated steel sheet comprised of mixed phases of fine crystals and an amorphous phase by water cooling plated steel sheet after hot dip plating or immersing the plated steel sheet in water right after hot dip plating.

Furthermore, to increase the cooling rate, there are the methods of making the substrate thinner, making the plating layer thinner, using a sub-zero alcohol based refrigerant, etc.

The volume percentage of the amorphous phase depends on the amorphous phase forming ability based on the plating composition. If the plating composition of the present invention, it is possible to obtain a plating layer containing an amorphous phase of at least 5 vol % by making the temperature of the plating layer substantially the same as the melting point of the plating bath and immersing it in 0° C. water.

In a system of ingredients to which Ca, Y, La, etc. are not added and with a small amorphous phase forming ability, in order to obtain an amorphous phase, it is possible to make the amount of plating deposition sufficiently small (for example, making the plating thickness 6 μm or less), make the temperature of the plating layer right before immersion in water substantially the same as the melting point, immerse it in 0° C. water, and sufficiently increase the cooling rate of the plating layer to thereby obtain a plating layer containing an amorphous phase of 5 vol % or more.

Conversely, in a system of ingredients in which Ca, Y, La, etc. are added, the amorphous phase forming ability is high, so even if the temperature right before water immersion is somewhat higher than the melting point of the plating bath, it is possible to obtain a plating layer comprised of a single phase of an amorphous phase by just immersion in ordinary temperature water.

When desiring to deliberately reduce the volume percentage of the amorphous phase, mist cooling is used or the temperature immediately before water immersion is raised.

The formation of an amorphous phase can be confirmed by a halo pattern being obtained in the X-ray diffraction pattern of the plating layer. If a single amorphous phase, only a halo pattern (when the plating layer is thin, sometimes the Fe diffraction peak of the steel material of the substrate is detected) is obtained.

When the amorphous phase and crystal phase are mixed, if the amorphous phase volume percentage is low, it is possible to use a differential scanning calorimeter to detect the exothermic peak when the amorphous phase crystallizes during the rise in temperature and thereby confirm the presence of the amorphous phase in the plating layer.

To find the volume percentage of the amorphous phase, the plated steel material is cut, the cross-section is polished and etched, and the plating layer of the surface is observed by an optical microscope.

At the part of the amorphous phase, no structure is observed due to etching, but at the part of the crystal phase, a structure due to crystal grain boundaries, sub-grain boundaries, precipitates, etc. is observed.

Due to this, it is possible to clearly differentiate the region of the amorphous phase part and the region of the crystal phase part, so it is possible to calculate the volume rate by the line segment method or image analysis.

When the structure is overly fine and measurement by an optical microscope is difficult, a thin piece is obtained from the cross-section of the plating layer and examined under a transmission electron microscope.

In the case of a transmission electron microscope, it is possible to confirm an amorphous structure by a halo pattern of an electron beam diffraction pattern in a region where no structure can be observed.

In observation by an optical microscope, when texture is not observed over the entire surface or when, even if there are parts where texture cannot be observed, there is a suspicion of being coarse, strain free crystal grains, it is preferable to further obtain a thin piece for an electron microscope and confirm that there are no diffraction spots on the electron beam diffraction pattern and that a halo pattern is observed so as to confirm that this is an amorphous phase.

With both an optical microscope and an electron microscope, it is preferable to find the area rate in 10 or more different fields by computer image processing, find the average of the found area rates, and use the result as the volume rate.

For the detection of the $Zn_3Mg_7$ in the plating layer, the general X-ray diffraction method is effective. For example, an X-ray diffraction apparatus using Cu—Kα rays is used to measure the diffraction pattern and judge presence by the presence of a $Zn_3Mg_7$ diffraction peak.

In this case, for identification of the $Zn_3Mg_7$ by the X-ray diffraction pattern, it is preferable to use the diffraction peak of $2\theta=10$ to 30°. This is because if over 30°, it overlaps with the strongest line of the Mg diffraction peak.

Further, when the amount of the $Zn_3Mg_7$ phase is small, judgment by TEM-EDX is also effective. The characteristic X-ray spectrum obtained from a specific crystal phase may be used to identify the $Zn_3Mg_7$.

EXAMPLES

Next, examples of the present invention will be explained. The conditions of the examples are examples of conditions employed for confirming the workability and effects of the present invention. The present invention is not limited to these examples of conditions. The present invention can employ various conditions so long as not departing from the gist of the present invention and achieving the object of the present invention.

Example 1

A surface treated steel material was prepared using a bath of each of the plating compositions shown in Tables 1 to 6 and cold rolled steel sheet of a thickness of 0.8 mm, equal angle steel of a thickness of 10 mm and a length per side of 10 cm, or hot rolled steel sheet of a thickness of 10 mm as a substrate.

Mg, Zn, and other necessary ingredient elements were adjusted to a predetermined composition, then a high frequency induction furnace was used to melt them in an Ar atmosphere to obtain an Mg—Zn alloy.

Scraps were taken from the prepared alloy and dissolved by acid. The solution was assayed by ICP (inductively coupled plasma) mass spectrometry to confirm that the prepared alloy matched with the composition shown in Tables 1 to 6. This alloy was used as the plating bath.

Cold rolled steel sheet (thickness of 0.8 mm) was cut to 10 cm×10 cm to obtain a test piece. This test piece was plated by a batch type hot dip plating test apparatus made by Rhesca. The bath temperature of the plating bath was made 500° C. Air wiping was used to adjust the amount of deposition, then nitrogen gas was used to cool the plating down to ordinary temperature.

For preparation of an amorphous hot dip plated steel sheet containing an amorphous phase in a volume percentage of 5% or more, the plated steel sheet was immersed in 0° C. water after hot dip plating.

For preparation of an amorphous hot dip plated steel sheet containing an amorphous phase in a volume percentage of less than 5%, the plated steel sheet was cooled by spraying high pressure mist from a close distance.

The equal angle steel was cut to 10 cm in the long direction, while the hot rolled steel sheet was cut to a square of 10 cm×10 cm to obtain a test piece.

First, this cut piece was hot dip plated in a Zn bath using the flux method using a crucible furnace to give an amount of deposition of about 100 g/m$^2$, then was immersed in a Zn—Mg alloy bath of the present invention composition and, as needed, cooled by immersion in 0° C. water.

The plating adhesion was evaluated, for a cold rolled steel sheet, by bending a plated test piece by 180° with the plating layer at the outside and subjecting it to an 8T bending test. After this, the plating layer of the bent part was peeled off by adhesive tape, the cross-section of the bent part was examined under an optical microscope, and the rate of deposition of the plating layer at the outer circumference of the cross-section of the bent part was found.

A residual rate of the plating layer after the test of 50 to 100% was evaluated as "G (good)" and less than 50% as "P (poor)". No plating layer was indicated by "–".

For hot rolled steel sheet and equal angle steel, the cross-section of the bent part was examined under an optical microscope and the rate of deposition of the plating layer at the outer circumference of the cross-section of the bent part was found. A test piece with a rate of deposition of the plating layer of 50 to 100% was evaluated as "G (good)" and less than 50% as "P (poor)". No deposition of plating layer was indicated by "–".

The formation of an amorphous phase of the surface of the plating layer is judged by using an X-ray diffraction apparatus using Cu—Kα rays to measure the diffraction pattern and judging the presence of a halo pattern.

When the amorphous phase and crystal phase are mixed, if the volume percentage of the amorphous phase is low, a differential scanning calorimeter can be used to detect the exothermic peak when crystallizing from the amorphous phase during the rise in temperature so as to confirm the presence of the amorphous phase.

To quantitatively find the volume percentage of the amorphous phase for a plated steel sheet judged to have an amorphous phase, the plated steel sheet was cut, its cross-section was polished and etched, then the plating layer of the surface was examined under an optical microscope (×1000).

The area rate of the amorphous phase was found for 10 or more different fields by computer image processing and the area rates found were averaged to obtain the volume rate.

The corrosion resistance of the plated steel sheet was evaluated by applying the method based on an automotive standard (JASO M609-91, 8 hours/cycle, wetting/drying time ratio 50%) for 21 cycles. For the salt water, 0.5% saline was used. The corrosion resistance was evaluated by the corrosion loss calculated from the corrosion loss and density after the tests.

A corrosion loss of less than 0.5 μm was evaluated as "VG (very good)", 0.5 to 1 μm as "G (good)", 1 to 2 μm as "SG (somewhat good)", 2 to 3 μm as "F (fair)", and 3 μm or more as "P (poor)". In Tables 1 to 6, test pieces with plating adhesions evaluated as "P" were not evaluated for corrosion resistance, so "–" are shown.

TABLE 1

| | Steel | | | Plating composition (atm %) | | | | | | | | | | | | | | | | Adhesion | Corrosion resistance | Amorphous percentage |
|---|---|---|---|---|---|---|---|---|---|---|---|---|---|---|---|---|---|---|---|---|---|---|
| | No. | material | Phase | Zn | Mg | Al | Ca | La | Y | Si | Ti | Cr | Cu | Fe | Ni | Zr | Nb | Mo | Ag | | | (%) |
| Present invention | 1-1 | Cold rolled steel sheet | C | 15 | 85 | | | | | | | | | | | | | | | G | F | 0 |
| | 1-2 | | C | 20 | 80 | | | | | | | | | | | | | | | G | F | 0 |
| | 1-3 | | C | 25 | 75 | | | | | | | | | | | | | | | G | F | 0 |
| | 1-4 | | C | 30 | 70 | | | | | | | | | | | | | | | G | F | 0 |
| | 1-5 | | C | 35 | 65 | | | | | | | | | | | | | | | G | F | 0 |
| | 1-6 | | C | 40 | 60 | | | | | | | | | | | | | | | G | F | 0 |
| | 1-7 | | C | 44 | 56 | | | | | | | | | | | | | | | G | F | 0 |
| | 1-8 | | C | 30 | 65 | | | | | | | | 5 | | | | | | | G | SG | 0 |
| | 1-9 | | C | 30 | 67 | | | | | | | | | | | | | | 3 | G | SG | 0 |
| | 1-10 | | C | 30 | 67 | | | | | | | | | | 3 | | | | | G | SG | 0 |
| | 1-11 | | C | 30 | 68 | | | | | | | | 1 | | 1 | | | | | G | SG | 0 |
| | 1-12 | | C | 30 | 69 | | | | | | | | | 1 | | | | | | G | SG | 0 |
| | 1-13 | | C | 30 | 69 | | | | | | | 1 | | | | | | | | G | SG | 0 |
| | 1-14 | | C | 30 | 69.5 | | | | | | 0.5 | | | | | | | | | G | SG | 0 |
| | 1-15 | | C | 30 | 69.97 | | | | | | | | | | | 0.03 | | | | G | SG | 0 |
| | 1-16 | | C | 30 | 69.97 | | | | | | | | | | | | | 0.03 | | G | SG | 0 |
| | 1-17 | | C | 30 | 69.8 | | | | | 0.2 | | | | | | | | | | G | SG | 0 |
| | 1-18 | | C | 30 | 69.97 | | | | | | | | | | | | 0.03 | | | G | SG | 0 |

* Notations in "Phase" column means the following: C: Plating layer comprised of only crystal phase and A: Plating layer including 5% or more amorphous phase.

TABLE 2

| | Steel | | | Plating composition (atm %) | | | | | | | | | | | | | | | | Adhesion | Corrosion resistance | Amorphous percentage |
|---|---|---|---|---|---|---|---|---|---|---|---|---|---|---|---|---|---|---|---|---|---|---|
| | No. | material | Phase | Zn | Mg | Al | Ca | La | Y | Si | Ti | Cr | Cu | Fe | Ni | Zr | Nb | Mo | Ag | | | (%) |
| Present invention | 2-1 | Cold rolled steel sheet | C | 30 | 65 | 5 | | | | | | | | | | | | | | G | SG | 0 |
| | 2-2 | | C | 25 | 65 | 10 | | | | | | | | | | | | | | G | SG | 0 |
| | 2-3 | | C | 15 | 70 | 15 | | | | | | | | | | | | | | G | SG | 0 |
| | 2-4 | | C | 50 | 48 | | 2 | | | | | | | | | | | | | G | SG | 0 |
| | 2-5 | | C | 15 | 80 | | 5 | | | | | | | | | | | | | G | SG | 0 |
| | 2-6 | | C | 20 | 75 | | 5 | | | | | | | | | | | | | G | SG | 0 |
| | 2-7 | | C | 25 | 70 | | 5 | | | | | | | | | | | | | G | SG | 0 |
| | 2-8 | | C | 30 | 65 | | 5 | | | | | | | | | | | | | G | SG | 0 |
| | 2-9 | | C | 35 | 60 | | 5 | | | | | | | | | | | | | G | SG | 0 |
| | 2-10 | | C | 40 | 55 | | 5 | | | | | | | | | | | | | G | SG | 0 |
| | 2-11 | | C | 45 | 50 | | 5 | | | | | | | | | | | | | G | SG | 0 |
| | 2-12 | | C | 50 | 45 | | 5 | | | | | | | | | | | | | G | SG | 0 |
| | 2-13 | | C | 55 | 40 | | 5 | | | | | | | | | | | | | G | SG | 0 |
| | 2-14 | | C | 59 | 36 | | 5 | | | | | | | | | | | | | G | SG | 0 |
| | 2-15 | | C | 30 | 60 | | 10 | | | | | | | | | | | | | G | SG | 0 |
| | 2-16 | | C | 20 | 70 | | 10 | | | | | | | | | | | | | G | SG | 0 |
| | 2-17 | | C | 40 | 50 | | 10 | | | | | | | | | | | | | G | SG | 0 |
| | 2-18 | | C | 25 | 60 | | 15 | | | | | | | | | | | | | G | SG | 0 |

* Notations in "Phase" column means the following: C: Plating layer comprised of only Crystal phase and A: Plating layer including 5% or more amorphous phase.

TABLE 3

| | No. | steel material | Phase | Plating composition (atm %) Zn | Mg | Al | Ca | La | Y | Si | Ti | Cr | Cu | Fe | Ni | Zr | Nb | Mo | Ag | Adhesion | Corrosion resistance | Amorphous percentage (%) |
|---|---|---|---|---|---|---|---|---|---|---|---|---|---|---|---|---|---|---|---|---|---|---|
| Present invention | 3-1 | Cold rolled steel sheet | C | 40 | 45 | | 15 | | | | | | | | | | | | | G | SG | 0 |
| | 3-2 | | C | 25 | 70 | | | 5 | | | | | | | | | | | | G | SG | 0 |
| | 3-3 | | C | 30 | 60 | | | 10 | | | | | | | | | | | | G | SG | 0 |
| | 3-4 | | C | 25 | 60 | 5 | | 10 | | | | | | | | | | | | G | SG | 0 |
| | 3-5 | | C | 25 | 60 | | 5 | 10 | | | | | | | | | | | | G | SG | 0 |
| | 3-6 | | C | 25 | 70 | | | | 5 | | | | | | | | | | | G | SG | 0 |
| | 3-7 | | C | 30 | 60 | | | | 10 | | | | | | | | | | | G | SG | 0 |
| | 3-8 | | C | 25 | 60 | 5 | | | 10 | | | | | | | | | | | G | SG | 0 |
| | 3-9 | | C | 25 | 65 | | 5 | | | | | | 5 | | | | | | | G | G | 0 |
| | 3-10 | | C | 27 | 65 | | 5 | | | | | | | | | | | | 3 | G | G | 0 |
| | 3-11 | | C | 27 | 65 | | 5 | | | | | | | | 3 | | | | | G | G | 0 |
| | 3-12 | | C | 29 | 65 | | 5 | | | | | | | 1 | | | | | | G | G | 0 |
| | 3-13 | | C | 29 | 65 | | 5 | | | | | 1 | | | | | | | | G | G | 0 |
| | 3-14 | | C | 29.5 | 65 | | 5 | | | | 0.5 | | | | | | | | | G | G | 0 |
| | 3-15 | | C | 29.97 | 65 | | 5 | | | | | | | | | 0.03 | | | | G | G | 0 |
| | 3-16 | | C | 29.97 | 65 | | 5 | | | | | | | | | | | 0.03 | | G | G | 0 |
| | 3-17 | | C | 29.8 | 65 | | 5 | | | 0.2 | | | | | | | | | | G | G | 0 |
| | 3-18 | | C | 29.97 | 65 | | 5 | | | | | | | | | | 0.03 | | | G | G | 0 |

* Notations in "Phase" column means the following: C: Plating layer comprised of only crystal phase and A: Plating layer including 5% or more amorphous phase.

TABLE 4

| | No. | Steel material | Phase | Plating composition (atm %) Zn | Mg | Al | Ca | La | Y | Si | Ti | Cr | Cu | Fe | Ni | Zr | Nb | Mo | Ag | Adhesion | Corrosion resistance | Amorphous percentage (%) |
|---|---|---|---|---|---|---|---|---|---|---|---|---|---|---|---|---|---|---|---|---|---|---|
| Present invention | 4-1 | Cold rolled steel sheet | A | 25 | 75 | | | | | | | | | | | | | | | G | SG | 5 |
| | 4-2 | | A | 30 | 70 | | | | | | | | | | | | | | | G | SG | 5 |
| | 4-3 | | A | 15 | 80 | | 5 | | | | | | | | | | | | | G | G | 10 |
| | 4-4 | | A | 20 | 75 | | 5 | | | | | | | | | | | | | G | VG | 90 |
| | 4-5 | | A | 25 | 70 | | 5 | | | | | | | | | | | | | G | VG | 100 |
| | 4-6 | | A | 30 | 65 | | 5 | | | | | | | | | | | | | G | VG | 100 |
| | 4-7 | | A | 35 | 60 | | 5 | | | | | | | | | | | | | G | VG | 90 |
| | 4-8 | | A | 30 | 60 | | 10 | | | | | | | | | | | | | G | G | 80 |
| | 4-9 | | A | 20 | 70 | | 10 | | | | | | | | | | | | | G | G | 50 |
| | 4-10 | | A | 25 | 60 | | 15 | | | | | | | | | | | | | G | G | 45 |
| | 4-11 | | A | 25 | 70 | | | 5 | | | | | | | | | | | | G | G | 80 |
| | 4-12 | | A | 30 | 60 | | | 10 | | | | | | | | | | | | G | G | 70 |
| | 4-13 | | A | 25 | 60 | | 5 | 10 | | | | | | | | | | | | G | G | 20 |
| | 4-14 | | A | 25 | 70 | | | | 5 | | | | | | | | | | | G | G | 70 |
| | 4-15 | | A | 30 | 60 | | | | 10 | | | | | | | | | | | G | G | 20 |
| | 4-16 | | A | 25 | 65 | | 5 | | | | | | 5 | | | | | | | G | VG | 70 |
| | 4-17 | | A | 27 | 65 | | 5 | | | | | | | | | | | 3 | | G | VG | 80 |
| | 4-18 | | A | 27 | 65 | | 5 | | | | | | | | 3 | | | | | G | VG | 80 |

* Notations in "Phase" column means the following: C: Plating layer comprised of only crystal phase and A: Plating layer including 5% or more amorphous phase.

TABLE 5

| | No. | Steel material | Phase | Plating composition (atm %) Zn | Mg | Al | Ca | La | Y | Si | Ti | Cr | Cu | Fe | Ni | Zr | Nb | Mo | Ag | Adhesion | Corrosion resistance | Amorphous percentage (%) |
|---|---|---|---|---|---|---|---|---|---|---|---|---|---|---|---|---|---|---|---|---|---|---|
| Present invention | 5-1 | Cold rolled steel sheet | A | 29 | 65 | | 5 | | | | | | | 1 | | | | | | G | VG | 100 |
| | 5-2 | | A | 29 | 65 | | 5 | | | | | 1 | | | | | | | | G | VG | 100 |
| | 5-3 | | A | 29.5 | 65 | | 5 | | | | 0.5 | | | | | | | | | G | VG | 100 |
| | 5-4 | | A | 29.97 | 65 | | 5 | | | | | | | | | 0.03 | | | | G | VG | 100 |
| | 5-5 | | A | 29.97 | 65 | | 5 | | | | | | | | | | | 0.03 | | G | VG | 100 |
| | 5-6 | | A | 29.8 | 65 | | 5 | | | 0.2 | | | | | | | | | | G | VG | 100 |
| | 5-7 | | A | 29.97 | 65 | | 5 | | | | | | | | | | 0.03 | | | G | VG | 100 |
| | 5-8 | Hot rolled steel sheet | C | 25 | 70 | | 5 | | | | | | | | | | | | | G | SG | 0 |
| | 5-9 | | A | 25 | 70 | | 5 | | | | | | | | | | | | | G | VG | 40 |

TABLE 5-continued

| No. | Steel material | Phase | Plating composition (atm %) Zn | Mg | Al | Ca | La | Y | Si | Ti | Cr | Cu | Fe | Ni | Zr | Nb | Mo | Ag | Adhesion | Corrosion resistance | Amorphous percentage (%) |
|---|---|---|---|---|---|---|---|---|---|---|---|---|---|---|---|---|---|---|---|---|---|
| 5-10 | Equal angle steel | C | 25 | 70 | | 5 | | | | | | | | | | | | | G | SG | 0 |
| 5-11 | | A | 25 | 70 | | 5 | | | | | | | | | | | | | G | VG | 40 |

* Notations in "Phase" column means the following: C: Plating layer comprised of only crystal phase and A: Plating layer including amorphous phase.

TABLE 6

| | No. | Steel material | Phase | Plating composition (atm %) Zn | Mg | Al | Ca | La | Y | Si | Ti | Cr | Cu | Fe | Ni | Zr | Nb | Mo | Ag | Adhesion | Corrosion resistance | Amorphous percentage (%) |
|---|---|---|---|---|---|---|---|---|---|---|---|---|---|---|---|---|---|---|---|---|---|---|
| Comp. ex. | 6-1 | Cold rolled steel sheet | C | 100 | | | | | | | | | | | | | | | | G | P | 0 |
| | 6-2 | | C | 13 | 87 | | | | | | | | | | | | | | | — | — | 0 |
| | 6-3 | | C | 45 | 55 | | | | | | | | | | | | | | | P | — | 0 |
| | 6-4 | | C | 50 | 49 | | 1 | | | | | | | | | | | | | P | — | 0 |
| | 6-5 | | C | 60 | 35 | | 5 | | | | | | | | | | | | | P | — | 0 |
| | 6-6 | | C | 40 | 40 | 20 | | | | | | | | | | | | | | P | — | 0 |
| | 6-7 | | C | 20 | 60 | | 20 | | | | | | | | | | | | | P | — | 0 |
| | 6-8 | | C | 30 | 50 | | 20 | | | | | | | | | | | | | P | — | 0 |
| | 6-9 | | C | 20 | 60 | | 20 | | | | | | | | | | | | | P | — | 0 |
| | 6-10 | | C | 20 | 67 | | 5 | | | | | | 8 | | | | | | | P | — | 0 |
| Inv. ex. | 6-11 | | C | 20 | 75 | | 5 | | | | | | | | | | | | | G | SG | 3 |
| | 6-12 | | C | 25 | 70 | | 5 | | | | | | | | | | | | | G | SG | 4 |
| | 6-13 | | C | 30 | 65 | | 5 | | | | | | | | | | | | | G | SG | 3 |

* Notations in "Phase" column means the following: C: Plating layer comprised of only crystal phase or plating layer including less than 5% amorphous phase and A: Plating layer including 5% or more amorphous phase.

As shown in Table 1 to 6, the hot dip Mg—Zn plated steel material of the present invention maintains sufficient performance in plating adhesion. The corrosion resistances of the steels of the present invention are all better than that of the hot dip Zn plated steel sheet (No. 6-1).

The plated steel materials containing Si, Ti, Cr, Cu, Fe, Ni, Zr, Nb, Mo, Ag, Al, Ca, Y, and/or La in the plating layers are further superior in corrosion resistance. Among these, the plated steel materials provided with plating layers containing the above elements and containing amorphous phases are particularly superior in corrosion resistance.

Table 7 and Table 8 show the results of evaluation of the corrosion resistance comparing amorphous hot dip plated steel sheet and plated steel sheet of only crystal phases. As clear from Table 7 and Table 8, plated steel sheet having amorphous phases in the case of the same ingredients are superior in the point of corrosion resistance.

TABLE 7

| No. | Phase | Plating composition (atm %) Zn | Mg | Al | Ca | La | Y | Si | Ti | Cr | Cu | Fe | Ni | Zr | Nb | Mo | Ag | Amorphous percentage (%) | Corrosion resistance |
|---|---|---|---|---|---|---|---|---|---|---|---|---|---|---|---|---|---|---|---|
| 1-3 | C | 25 | 75 | | | | | | | | | | | | | | | 0 | F |
| 4-1 | A | 25 | 75 | | | | | | | | | | | | | | | 5 | SG |
| 1-4 | C | 30 | 70 | | | | | | | | | | | | | | | 0 | F |
| 4-2 | A | 30 | 70 | | | | | | | | | | | | | | | 5 | SG |
| 2-5 | C | 15 | 80 | | 5 | | | | | | | | | | | | | 0 | SG |
| 4-3 | A | 15 | 80 | | 5 | | | | | | | | | | | | | 10 | G |
| 2-6 | C | 20 | 75 | | 5 | | | | | | | | | | | | | 0 | SG |
| 4-4 | A | 20 | 75 | | 5 | | | | | | | | | | | | | 90 | VG |
| 2-7 | C | 25 | 70 | | 5 | | | | | | | | | | | | | 0 | SG |
| 4-5 | A | 25 | 70 | | 5 | | | | | | | | | | | | | 100 | VG |
| 2-8 | C | 30 | 65 | | 5 | | | | | | | | | | | | | 0 | SG |
| 4-6 | A | 30 | 65 | | 5 | | | | | | | | | | | | | 100 | VG |
| 2-9 | C | 35 | 60 | | 5 | | | | | | | | | | | | | 0 | SG |
| 4-7 | A | 35 | 60 | | 5 | | | | | | | | | | | | | 90 | VG |
| 2-15 | C | 30 | 60 | | 10 | | | | | | | | | | | | | 0 | SG |
| 4-8 | A | 30 | 60 | | 10 | | | | | | | | | | | | | 80 | G |
| 2-16 | C | 20 | 70 | | 10 | | | | | | | | | | | | | 0 | SG |
| 4-9 | A | 20 | 70 | | 10 | | | | | | | | | | | | | 50 | G |
| 2-18 | C | 25 | 60 | | 15 | | | | | | | | | | | | | 0 | SG |
| 4-10 | A | 25 | 60 | | 15 | | | | | | | | | | | | | 45 | G |
| 3-2 | C | 25 | 70 | | | 5 | | | | | | | | | | | | 80 | SG |

TABLE 7-continued

| No. | Phase | Plating composition (atm %) Zn | Mg | Al | Ca | La | Y | Si | Ti | Cr | Cu | Fe | Ni | Zr | Nb | Mo | Ag | Amorphous percentage (%) | Corrosion resistance |
|---|---|---|---|---|---|---|---|---|---|---|---|---|---|---|---|---|---|---|---|
| 4-11 | A | 25 | 70 | | | 5 | | | | | | | | | | | | 80 | G |
| 3-3 | C | 30 | 60 | | | 10 | | | | | | | | | | | | 0 | SG |
| 4-12 | A | 30 | 60 | | | 10 | | | | | | | | | | | | 70 | G |

* Notations in "Phase" column means the following: C: Plating layer comprised of only crystal phase and A: Plating layer including 5% or more amorphous phase.

TABLE 8

| No. | Phase | Plating composition (atm %) Zn | Mg | Al | Ca | La | Y | Si | Ti | Cr | Cu | Fe | Ni | Zr | Nb | Mo | Ag | Amorphous percentage (%) | Corrosion resistance |
|---|---|---|---|---|---|---|---|---|---|---|---|---|---|---|---|---|---|---|---|
| 3-5 | C | 25 | 60 | | 5 | 10 | | | | | | | | | | | | 0 | SG |
| 4-13 | A | 25 | 60 | | 5 | 10 | | | | | | | | | | | | 20 | G |
| 3-6 | C | 25 | 70 | | | | 5 | | | | | | | | | | | 0 | SG |
| 4-14 | A | 25 | 70 | | | | 5 | | | | | | | | | | | 70 | G |
| 3-7 | C | 30 | 60 | | | | 10 | | | | | | | | | | | 0 | SG |
| 4-15 | A | 30 | 60 | | | | 10 | | | | | | | | | | | 20 | G |
| 3-9 | C | 25 | 65 | | 5 | | | | | | 5 | | | | | | | 0 | G |
| 4-16 | A | 25 | 65 | | 5 | | | | | | 5 | | | | | | | 70 | VG |
| 3-10 | C | 27 | 65 | | 5 | | | | | | | | | | | | 3 | 0 | G |
| 4-17 | A | 27 | 65 | | 5 | | | | | | | | | | | | 3 | 80 | VG |
| 3-11 | C | 27 | 65 | | 5 | | | | | | | | 3 | | | | | 0 | G |
| 4-18 | A | 27 | 65 | | 5 | | | | | | | | 3 | | | | | 80 | VG |
| 3-12 | C | 29 | 65 | | 5 | | | | | | | 1 | | | | | | 0 | G |
| 5-1 | A | 29 | 65 | | 5 | | | | | | | 1 | | | | | | 100 | VG |
| 3-13 | C | 29 | 65 | | 5 | | | | | 1 | | | | | | | | 0 | G |
| 5-2 | A | 29 | 65 | | 5 | | | | | 1 | | | | | | | | 100 | VG |
| 3-14 | C | 29.5 | 65 | | 5 | | | | 0.5 | | | | | | | | | 0 | G |
| 5-3 | A | 30 | 65 | | 5 | | | | 0.5 | | | | | | | | | 100 | VG |
| 3-15 | C | 29.97 | 65 | | 5 | | | | | | | | | 0.03 | | | | 0 | G |
| 5-4 | A | 30 | 65 | | 5 | | | | | | | | | 0.03 | | | | 100 | VG |
| 3-16 | C | 29.97 | 65 | | 5 | | | | | | | | | | | 0.03 | | 0 | G |
| 5-5 | A | 30 | 65 | | 5 | | | | | | | | | | | 0.03 | | 100 | VG |
| 3-17 | C | 29.8 | 65 | | 5 | | | 0.2 | | | | | | | | | | 0 | G |
| 5-6 | A | 30 | 65 | | 5 | | | 0.2 | | | | | | | | | | 100 | VG |
| 3-18 | C | 29.97 | 65 | | 5 | | | | | | | | | | 0.03 | | | 0 | G |
| 5-7 | A | 30 | 65 | | 5 | | | | | | | | | | 0.03 | | | 100 | VG |

* Notations in "Phase" column means the following: C: Plating layer comprised of only crystal phase and A: Plating layer including 5% or more amorphous phase.

Figure 6:
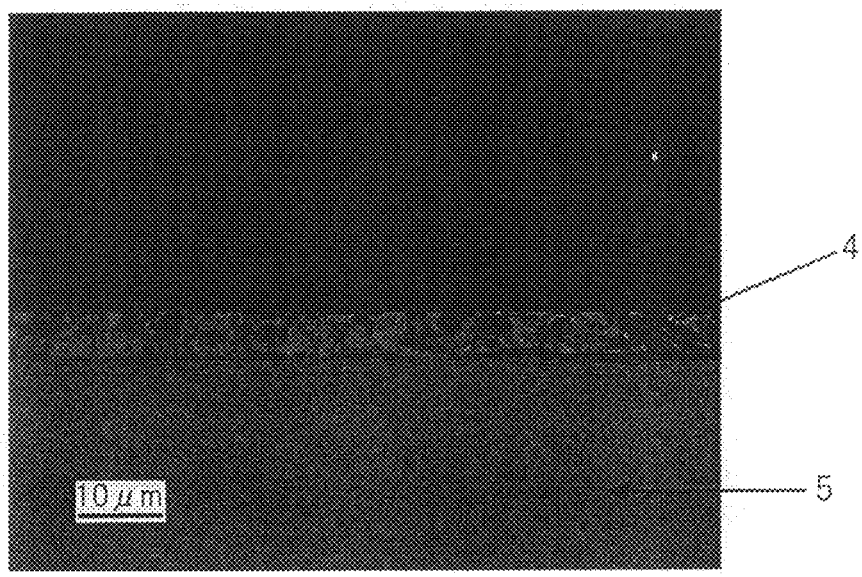
FIG. 6 is a view showing the cross-sectional structure of an Mg-25 atm % Zn-5 atm % Ca plating layer (crystal phase).

FIG. 6 shows the cross-section of the Plated Steel Sheet No. 2-7 (amount of deposition 20 g/m$^2$) provided with a Mg-25 atm % Zn-5 atm % Ca plating layer (crystal phase).

As can be judged from FIG. 6, there are no cracks or peeling at the interface of the steel sheet 5 and Mg-25 atm % Zn-5 atm % Ca plating layer (crystal phase) 4. It will be understood that at the steel sheet 5 and Mg-25 atm % Zn-5 atm % Ca plating layer (crystal phase) 4, a good adhesion is obtained and that an Mg—Zn alloy containing Mg in a high concentration can be hot dip plated on steel sheet.

Figure 7:
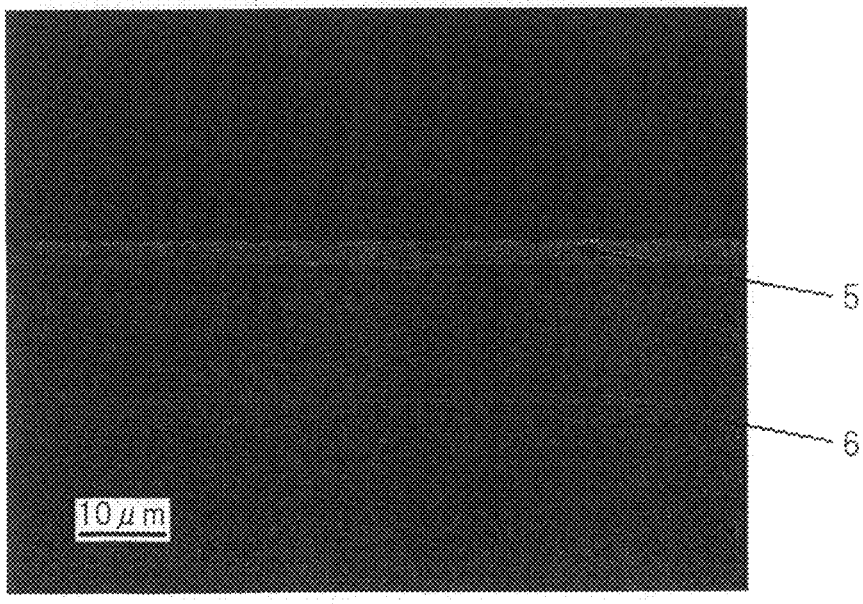
FIG. 7 is a view showing the cross-sectional structure of an Mg-25 atm % Zn-5 atm % Ca plating layer (amorphous phase).

FIG. 7 shows the cross-section of the Plated Steel Sheet No. 4-5 (amount of deposition 20 g/m$^2$) obtained by cooling Mg by immersion in water and forming an Mg-25 atm % Zn-5 atm % Ca plating layer (amorphous phase) 6 on the steel sheet 5.

Figure 8:
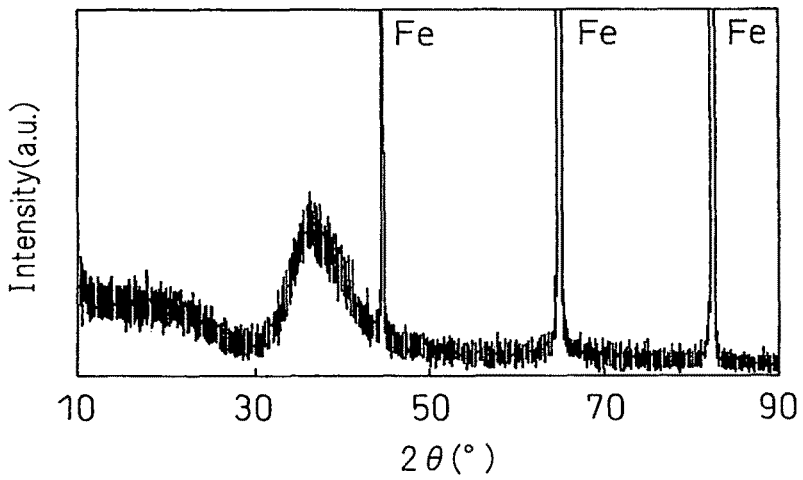
FIG. 8 is a view showing an X-ray diffraction pattern of an Mg-25 atm % Zn-5 atm % Ca plating layer (amorphous phase).

FIG. 8 shows the X-ray-diffraction pattern of this plating layer. By the detection of a halo pattern in the X-ray diffraction pattern, it is learned that the Mg-25 atm % Zn-5 atm % Ca plating layer (amorphous phase) 6 shown in FIG. 7 is an amorphous phase.

Figure 9:
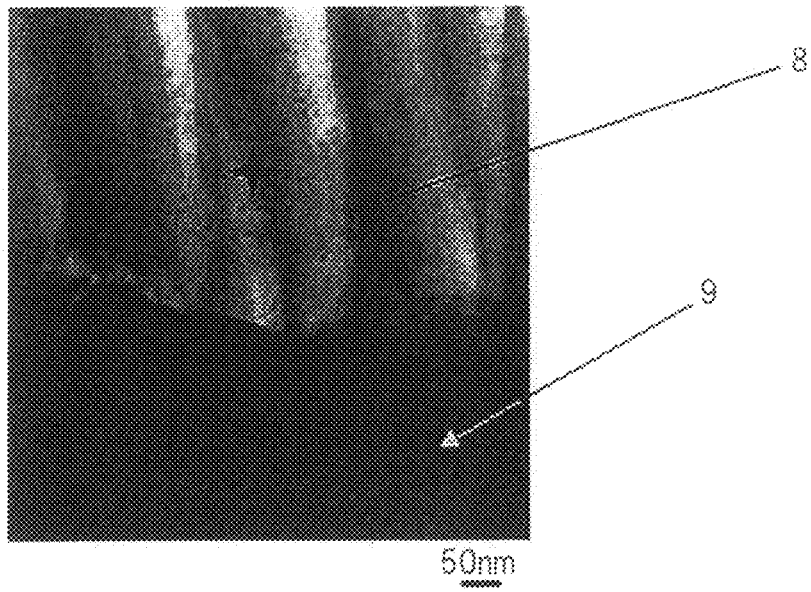
FIG. 9 is a view showing an FE-TEM image (bright field image) near the interface of an Mg-25 atm % Zn-5 atm % Ca plating layer (amorphous phase).

FIG. 9 shows an FE-TEM image (bright field image) near the interface of the plated steel sheet comprised of the steel sheet 9 formed with an Mg-25 atm % Zn-5 atm % Ca plating layer (amorphous phase) 8.

Figure 10:
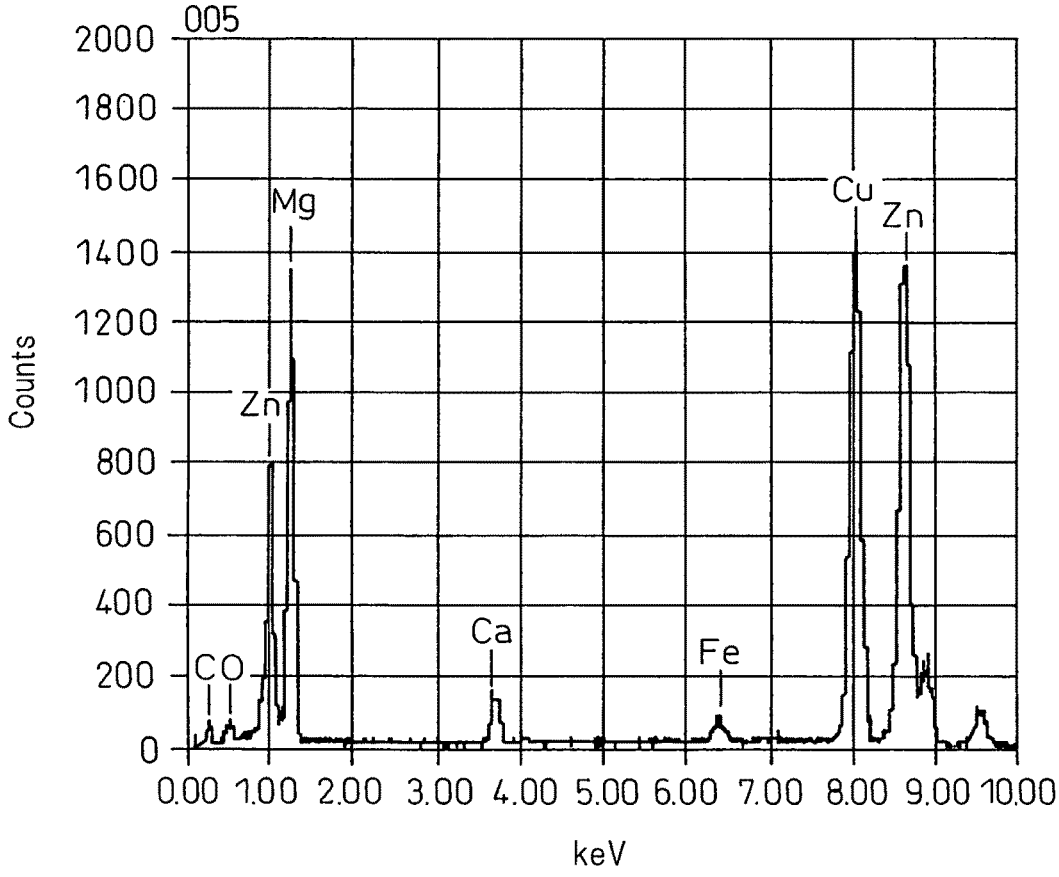
FIG. 10 is a view showing the results of elemental analysis by EDX at the cross point in the FE-TEM image shown in FIG. 9.

FIG. 10 shows the result of elemental analysis by EDX at the cross point of FE-TEMA of FIG. 9. It will be understood that Fe is diffused inside the plating layer.

Figure 11:
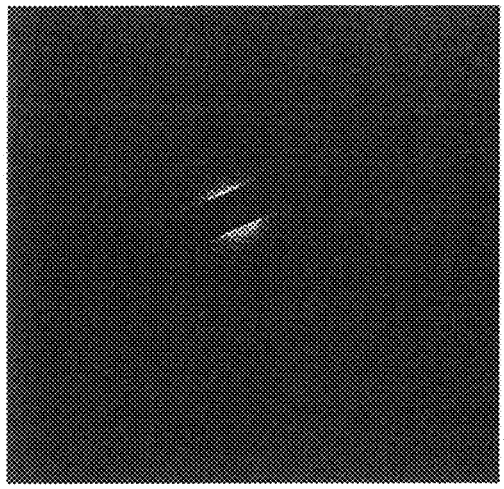
FIG. 11 is a view showing an electron beam diffraction pattern at the cross point in the FE-TEM image shown in FIG. 9.

FIG. 11 shows an electron beam diffraction pattern at a cross point of the FE-TEM image of FIG. 9. A halo pattern is detected. It will be understood that the Mg-25 atm % Zn-5 atm % Ca plating layer (amorphous phase) 8 shown in FIG. 9 is an amorphous phase even near the interface and is a single amorphous phase.

Example 2

A surface treated steel material was prepared using a bath of each of the plating compositions shown in Table 9 and cold rolled steel sheet of a thickness of 0.8 mm as a substrate. The substrate was pretreated for preplating by alkali degreasing and pickling.

The Ni preplating layer was formed by dipping a test piece in a 30° C. aqueous solution containing nickel sulfate: 125 g/l, ammonium citrate: 135 g/l, and sodium hypophosphate: 110 g/l mixed together and adjusted by sodium hydroxide to pH10.

The Co preplating layer was formed by dipping a test piece in a 90° C. aqueous solution containing cobalt sulfate: 15 g/l, sodium hypophosphate: 21 g/l, sodium citrate: 60 g/l, and ammonium sulfate: 65 g/l mixed together and adjusted by aqueous ammonium to pH10.

The Cu preplating layer was fabricated by dipping a test piece in a 25° C. aqueous solution containing copper sulfate: 2 g/l and sulfuric acid: 30 g/l mixed together.

The Cu—Sn preplating layer was fabricated by dipping a test piece in a 25° C. aqueous solution containing copper chloride: 3.2 g/l, stannous chloride: 5.0 g/l, and hydrochloric acid: 8 g/l mixed together.

The Ag preplating layer was fabricated by electroplating in a solution of silver cyanide 2 g/l and potassium cyanide 80 g/l mixed together and a temperature of 30° C. by a current density of 2 A/dm$^2$.

The Cr preplating layer was fabricated by electroplating in a solution of anhydrous chromic acid 250 g/l and sulfuric acid 2.5 g/l mixed together and a temperature of 50° C. by a current density of 20 A/dm$^2$.

Using these plating baths, the dipping times were adjusted to make the deposition amounts 1 to 5 g/m$^2$. The amount of deposition of each preplating was determined by dissolving the preplating in nitric acid etc., quantitatively analyzing the solution by ICP (inductively coupled plasma) mass spectrometry, and converting the amounts of dissolved elements to the amount of deposition.

Mg, Zn, and other necessary elements were prepared into a predetermined composition, then a high frequency induction furnace was used to melt it in an Ar atmosphere to obtain an Mg—Zn alloy. Scraps were obtained from the prepared alloy and dissolved in an acid. The solution was then assayed by ICP (inductively coupled plasma) mass spectrometry to confirm that the prepared alloy matched the composition shown in Table 9. This alloy was used as the plating bath.

Cold rolled steel sheet (thickness 0.8 mm) was cut to 10 cm×20 cm for use as a test piece. This test piece was plated by a batch type hot dip plating test apparatus made by Rhesca.

For the cold rolled steel sheet, one which was preplated and one in the original state were used. Each was hot dip plated. The bath temperature of the plating bath was made 400 to 600° C. The amount of deposition was adjusted by air wiping.

The dipping rate of the steel sheet in the plating bath was made 500 mm/sec. The sample was dipped for 3 second, adjusted in amount of deposition by air wiping, then immediately reheated and water cooled by water cooling, air cooling, or a later explained technique.

After dipping, the number of "non-plating defects" (visually discernable 1 mm or larger "non-plating defects") at the center part of the plated steel sheet (5 cm×10 cm) was counted and converted to the number of "non-plating defects" per 50 cm$^2$.

For each sample, the average was found for n=10. A number of "non-plating defects" of one or less was evaluated as "VG (very good)", 1 to 3 as "G (good)", 5 to 10 or more as "F (fair)", and 10 or more as "P (poor)".

The diffraction pattern of the surface forming phase at the center part (20 mm×20 mm) of the prepared plated steel sheet was measured by an X-ray diffraction apparatus using Cu—Kα rays.

Using X-ray diffraction, the surface forming phase was identified. One where a halo pattern was detected was evaluated as "G (good)", while one where it could not obtained or where mixture of a crystal phase made judgment difficult was evaluated as "F (fair)".

Further, a test piece with a diffraction peak of a high temperature stable phase $Zn_3Mg_7$ detected was evaluated as "E (excellent)". "Detection of a peak" means an X-ray intensity ratio (ratio of diffraction peak intensity of $Zn_3Mg_7$ (excluding diffraction peak of plane spacing of 0.233 nm) in the sum of all diffraction peak intensities appearing at diffraction plane intervals of 0.1089 to 1.766 nm, that is, diffraction angles 2θ of 5 to 90° in case of diffraction measurement by Cu—Kα rays using an X-ray tube with Cu target for the X-ray source (however, excluding diffraction peak of plane spacing of 0.233 nm) of 10% or more.

Figure 12:
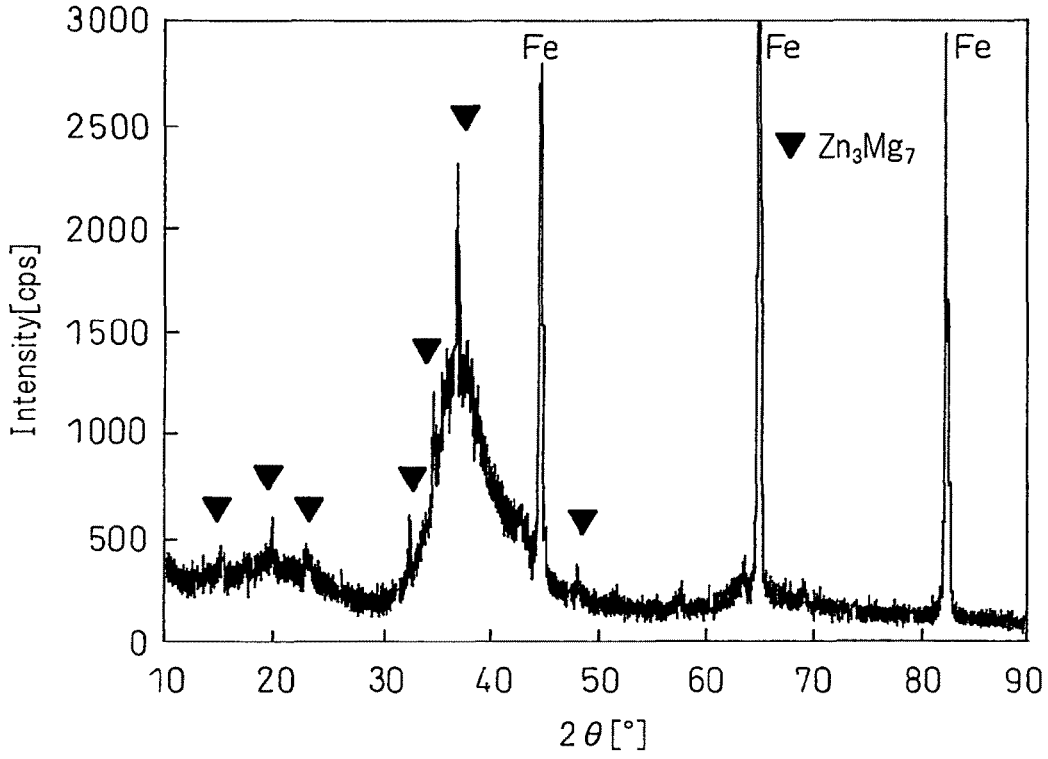
FIG. 12 is a view showing an X-ray diffraction pattern of an Mg-25 atm % Zn-5 atm % Ca-4 atm % Al plating layer of No. 16 in Table 9 (amorphous phase, $Zn_3Mg_7$).

Further, a halo pattern was evaluated as "G (good)", while observation of a diffraction peak of $Zn_3Mg_7$ as well was evaluated as "GE (good-excellent)". FIG. 12 shows an X-ray diffraction pattern of No. 16 in Table 9. This is an example of observation of both a halo pattern and $Zn_3Mg_7$.

For the reheating and water cooling, after the plating, the amount of deposition was adjusted by air wiping, then the test pieces were allowed to cool to ordinary temperature. After being allowed to stand at ordinary temperature, the test pieces were reheated to raise them in temperature to the hot dip plating bath temperature and held at this temperature for 10 seconds, then were water cooled.

The corrosion resistance of the plated steel sheet was evaluated by applying the method based on an auto standard (JASO M609-91, 8 hours/cycle, wetting/drying time ratio 50%) for 21 cycles. For the salt water, 0.5% saline was used. The corrosion resistance was evaluated by the corrosion loss calculated from the corrosion loss and density after the tests.

A corrosion loss of less than 0.5 μm was evaluated as "VG (very good)", 0.5 to 1 μm as "G (good)", 1 to 2 μm as "SG (somewhat good)", 2 to 3 μm as "F (fair)", and 3 μm or more as "P (poor)".

Figure 13:
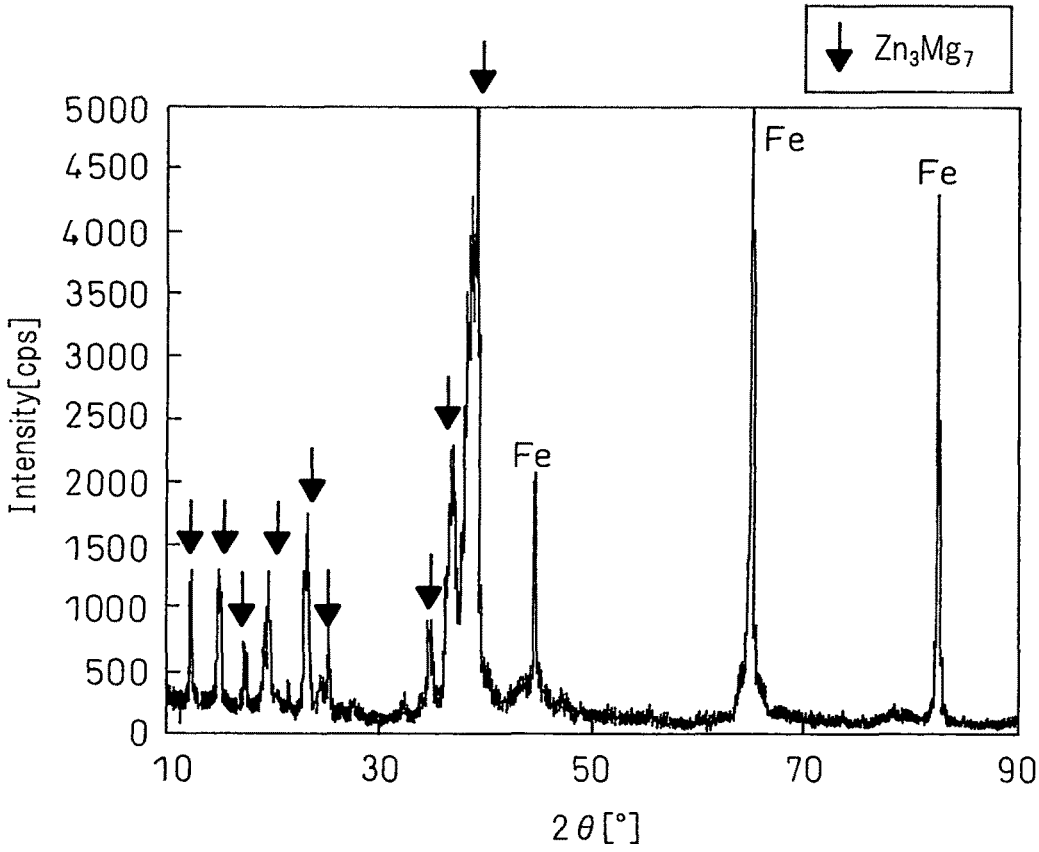
FIG. 13 is a view showing an X-ray diffraction pattern of an Mg-27 atm % Zn-1 atm % Ca-6 atm % Al plating layer ($Zn_3Mg_7$) of No. 3 in Table 9.

FIG. 13 shows the X-ray diffraction pattern of Mg-27 atm % Zn-1 atm % Ca-6 atm % Al of No. 3 in Table 9. From the X-ray diffraction pattern, only the diffraction line of $Zn_3Mg_7$ could be obtained. Ca and Al are believed to form substitution type solid solutions and exist in those forms.

Figure 14:
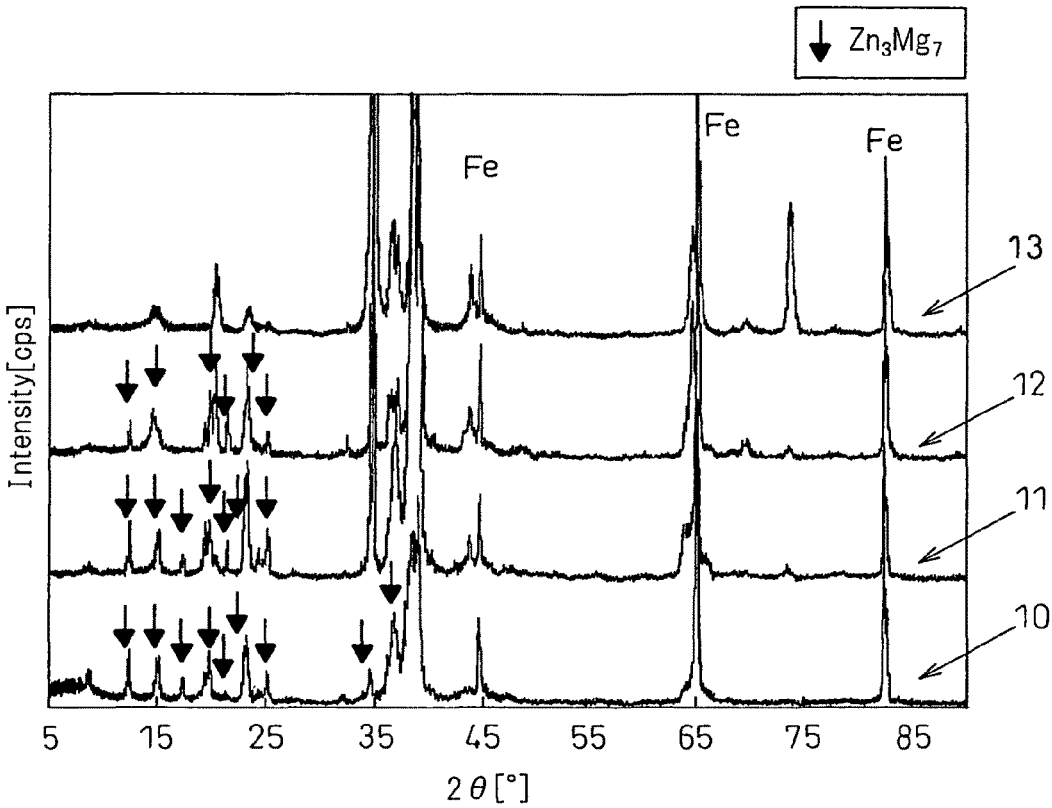
FIG. 14 is a view showing the X-ray diffraction pattern of an Mg-27 atm % Zn-1 atm % Ca-6 atm % Al plating layer of No. 3 in Table 9 (in the FIG. 10), the X-ray diffraction pattern of an Mg-27 atm % Zn-1 atm % Ca-8 atm % Al plating layer of No. 6 (in the FIG. 11), the X-ray diffraction pattern of an Mg-27 atm % Zn-1 atm % Ca-10 atm % Al plating layer of No. 7 (in the FIG. 12), and the X-ray diffraction pattern of an Mg-27 atm % Zn-1 atm % Ca-13 atm % Al plating layer of No. 8 (in the FIG. 13).

FIG. 14 shows the X-ray diffraction patterns of the plated steel sheet surface forming phases of No. 3 and No. 6 to No. 8 in Table 9.

10 shows the X-ray diffraction pattern of an Mg-27 atm % Zn-1 atm % Ca-6 atm % Al plating layer (No. 3), 11 shows the X-ray diffraction pattern of an Mg-27 atm % Zn-1 atm % Ca-8 atm % Al plating layer (No. 6), 12 shows the X-ray diffraction pattern of an Mg-27 atm % Zn-1 atm % Ca-10 atm % Al plating layer (No. 7), and 13 shows the X-ray diffraction pattern of an Mg-27 atm % Zn-1 atm % Ca-13 atm % Al plating layer (No. 8).

From the figure, it will be understood that in No. 3, the plating layer is a single $Zn_3Mg_7$ phase. As the Al concentration becomes higher, the amount of the $Zn_3Mg_7$ phase becomes smaller. In No. 8, it will be understood that the $Zn_3Mg_7$ almost completely disappears.

TABLE 9

| Class | No. | Steel | Preplating | Plating post treatment | Plating ingredients (atm %) Mg | Zn | Ca | Al | Plating bath temp. | XRD | Plating deposition | Non-plating defects (No.) | Corrosion resistance |
|---|---|---|---|---|---|---|---|---|---|---|---|---|---|
| Invention | 1 | Cold | Cu—Sn | Water cooling | 73.7 | 25 | 0.8 | 0.5 | 450 | E | 25 | VG | G |
| | 2 | rolled | Cu—Sn | Water cooling | 73 | 20 | 1 | 6 | 450 | E | 25 | VG | G |
| | 3 | steel | Cu—Sn | Water cooling | 66 | 27 | 1 | 6 | 450 | E | 25 | VG | VG |
| | 4 | sheet | None | Water cooling | | | | | 450 | E | 25 | F | VG |

TABLE 9-continued

| Class | No. | Steel | Preplating | Plating post treatment | Plating ingredients (atm %) Mg | Zn | Ca | Al | Plating bath temp. | XRD | Plating deposition | Non-plating defects (No.) | Corrosion resistance |
|---|---|---|---|---|---|---|---|---|---|---|---|---|---|
| | 5 | | Cu—Sn | Air cooling | | | | | 450 | F | 25 | VG | SG |
| | 6 | | Cu—Sn | Water cooling | 64 | 27 | 1 | 8 | 450 | E | 25 | VG | VG |
| | 7 | | Cu—Sn | Water cooling | 62 | 27 | 1 | 10 | 450 | E | 25 | VG | G |
| | 8 | | Cu—Sn | Water cooling | 59 | 27 | 1 | 13 | 500 | F | 25 | VG | SG |
| | 9 | | Cu—Sn | Water cooling | 63 | 30 | 1 | 6 | 450 | E | 25 | VG | VG |
| | 10 | | Cu—Sn | Water cooling | 58 | 35 | 1 | 6 | 500 | E | 25 | VG | G |
| | 11 | | Cu—Sn | Water cooling | 53 | 40 | 1 | 6 | 550 | E | 25 | VG | G |
| | 12 | | Cu—Sn | Water cooling | 64 | 25 | 5 | 6 | 500 | E | 25 | VG | G |
| | 13 | | Ni | Reheating & water cooling | 80 | 15 | 5 | | 550 | G | 30 | VG | G |
| | 14 | | Ni | Reheating & water cooling | 75 | 20 | 5 | | 500 | G | 30 | VG | VG |
| | 15 | | Ni | Reheating & water cooling | 70 | 25 | 5 | | 450 | G | 30 | VG | VG |
| | 16 | | Ni | Reheating & water cooling | 66 | 25 | 5 | 4 | 450 | GE | 30 | VG | VG |
| | 17 | | None | Water cooling | 70 | 25 | 5 | | 450 | G | 30 | F | VG |
| | 18 | | Ni | Water cooling | | | | | 450 | G | 30 | VG | VG |
| | 19 | | Cr | Water cooling | | | | | 450 | G | 30 | G | VG |
| | 20 | | Co | Water cooling | | | | | 450 | G | 30 | G | VG |
| | 21 | | Cu | Water cooling | | | | | 450 | G | 30 | G | VG |
| | 22 | | Ag | Water cooling | | | | | 450 | G | 30 | G | VG |
| | 23 | | Ni | Reheating & water cooling | 65 | 30 | 5 | | 450 | G | 30 | VG | VG |
| | 24 | | Ni | Reheating & water cooling | 62 | 30 | 5 | 3 | 450 | GE | 30 | VG | VG |
| | 25 | | Ni | Reheating & water cooling | 60 | 35 | 5 | | 500 | G | 30 | VG | VG |
| | 26 | | Ni | Reheating & water cooling | 55 | 40 | 1 | 4 | 500 | E | 30 | VG | G |
| | 27 | | Ni | Reheating & water cooling | 50 | 45 | 1 | 4 | 550 | E | 30 | VG | G |
| | 28 | | Ni | Air cooling | | | | | 550 | F | 30 | VG | SG |
| | 29 | | Ni | Reheating & water cooling | 53.7 | 45 | 0.8 | 0.5 | 550 | E | 30 | VG | G |
| | 30 | | Ni | Air cooling | | | | | 550 | F | 30 | VG | SG |
| | 31 | | Ni | Reheating & water cooling | 53.5 | 45 | 1.5 | | 550 | F | 30 | VG | G |
| | 32 | | Ni | Air cooling | | | | | 550 | F | 30 | VG | SG |
| | 33 | | Ni | Reheating & water cooling | 45 | 50 | 5 | | 550 | F | 30 | VG | G |
| | 34 | | Ni | Reheating & water cooling | 47.5 | 50 | 2 | 0.5 | 550 | F | 30 | VG | G |
| | 35 | | Ni | Reheating & water cooling | 48.5 | 50 | 1.5 | | 550 | F | 30 | VG | G |
| | 36 | | Ni | Reheating & water cooling | 43.5 | 55 | 1.5 | | 600 | F | 30 | VG | G |
| | 37 | | Ni | Reheating & water cooling | 40 | 55 | 5 | | 550 | F | 30 | VG | G |
| | 38 | | Ni | Reheating & water cooling | 36 | 59 | 5 | | 600 | F | 30 | VG | G |
| | 39 | | Ni | Reheating & water cooling | 70 | 20 | 10 | | 500 | G | 30 | VG | G |
| | 40 | | Ni | Reheating & water cooling | 40 | 50 | 10 | | 550 | F | 30 | VG | G |

INDUSTRIAL APPLICABILITY

As explained above, the present invention (hot dip Mg—Zn alloy plated steel material) enables production by an ordinary hot dip plating process and is superior in universality and economy.

Further, the hot dip Mg—Zn alloy plating layer of the present invention keeps down the concentration of Zn yet gives a corrosion resistance superior to that of a conventional hot dip Zn plating layer, so contributes to saving Zn resources.

Further, the hot dip Mg—Zn alloy plating layer of the present invention is excellent in not only corrosion resistance, but also workability, so the present invention can be widely utilized as structural members and functional members in the fields of automobiles, building materials, and household electrical appliances.

Accordingly, the present invention contributes to the development of the manufacturing industries by the increase in life of structural parts used in the automobile, building material, and household electrical appliance fields and the reduction of labor in maintenance.

The invention claimed is:

1. A Mg-based alloy plated steel material characterized by being provided with a hot dip Mg-based alloy plating layer containing Zn: 15 atm % or more, Mg: over 35 atm %, and further containing Ca and optionally one or more elements selected from the group of elements B: Al, and Y in a total of 0.03 to 15 atm %, wherein said hot dip Mg-based alloy plating layer comprises only crystal phase, and contains an intermetallic compound $Zn_3Mg_7$, wherein an X-ray intensity ratio of diffraction peak intensity of $Zn_3Mg_7$ relative to the sum of all diffraction peak intensities appearing at diffraction plane spacing of 0.1089 to 1.766 nm is 10% or more, wherein diffraction peak of diffraction plane spacing of 0.233 nm is excluded from determining said X-ray intensity ratio.

2. An Mg-based alloy plated steel material as set forth in claim 1, characterized in that said hot dip Mg-based alloy plating layer containing Mg: 85 atm % or less.

3. The Mg-based alloy plated steel material as set forth in claim 1, characterized in that said hot dip Mg-based alloy plating layer contains Mg: 55 to 80 atm %.

4. The Mg-based alloy plated steel material as set forth in claim 1 characterized in that said hot dip Mg-based alloy plating layer further contains one or more elements selected from the group of elements A: Si, Ti, Cr, Cu, Fe, Ni, Zr, Nb, Mo, and Ag in a total of 0.03 to 5 atm %.

5. The Mg-based alloy plated steel material as set forth in claim 1, characterized in that said hot dip Mg-based alloy plating layer containing Zn: 20 atm % or more, Mg: 50 atm % to 75 atm %, and further containing Ca and optionally one or more elements selected from the group of elements B: Al, and Y in a total of 0.03 to 12 atm %, here when said total is 1 to 12 atm %, containing Al: 1 atm % or more.

6. The Mg-based alloy plated steel material as set forth in claim 5, characterized in that said hot dip Mg-based alloy plating layer is a single $Zn_3Mg_7$ phase.

7. The Mg-based alloy plated steel material as set forth in claim 1, characterized in that said hot dip Mg-based alloy plating layer is subject to holding said plating layer at a temperature of a melting point of the Mg-based alloy plating to melting point of Mg-based alloy plating +100° C. for 1 minute or less, then rapidly cooling it.

8. The Mg-based alloy plated steel material as set forth in claim 7, characterized in that said rapid cooling is water cooling or mist water cooling.

9. The Mg-based alloy plated steel material as set forth in claim 1, characterized in that the interface between said hot dip Mg-based alloy plating layer and steel material is provided with a preplating layer comprised of one or more elements selected from Ni, Cu, Sn, Cr, Co, and Ag.

10. The Mg-based alloy plated steel material as set forth in claim 1, characterized in that said hot dip Mg-based alloy plating layer contains a balance of Mg and unavoidable impurities.

* * * * *

UNITED STATES PATENT AND TRADEMARK OFFICE

CERTIFICATE OF CORRECTION

PATENT NO. : 8,562,757 B2
APPLICATION NO. : 12/450195
DATED : October 22, 2013
INVENTOR(S) : Kohei Tokuda et al.

It is certified that error appears in the above-identified patent and that said Letters Patent is hereby corrected as shown below:

On the Title Page

Item (57), Abstract, change "An Mg-based" to -- A Mg-based --;

In the Specification

Column 1, line 13, change "An Mg-based" to -- A Mg-based --;

Column 2, line 56, change "an Mg" to -- a Mg --;

Column 3, line 44, change "an Mg" to -- a Mg --;

Column 3, line 60, change "an Mg" to -- a Mg --;

Column 4, line 63, change "An Mg-based" to -- A Mg-based --;

Column 4, line 65, change "An Mg-based" to -- A Mg-based --;

Column 5, line 1, change "An Mg-based" to -- A Mg-based --;

Column 5, line 7, change "An Mg-based" to -- A Mg-based --;

Column 5, line 13, change "An Mg-based" to -- A Mg-based --;

Column 5, line 20, change "An Mg-based" to -- A Mg-based --;

Column 5, line 23, change "An Mg-based" to -- A Mg-based --;

Column 5, line 26, change "An Mg-based" to -- A Mg-based --;

Column 5, line 31, change "An Mg-based" to -- A Mg-based --;

Column 5, line 36, change "An Mg-based" to -- A Mg-based --;

Column 5, line 48, change "An Mg-based" to -- A Mg-based --;

Column 5, line 57, change "An Mg-based" to -- A Mg-based --;

Column 5, line 65, change "An Mg-based" to -- A Mg-based --;

Column 6, line 5, change "An Mg-based" to -- A Mg-based --;

Column 6, line 9, change "An Mg-based" to -- A Mg-based --;

Signed and Sealed this
Twenty-third Day of September, 2014

Michelle K. Lee

Michelle K. Lee
*Deputy Director of the United States Patent and Trademark Office*

Column 6, line 12, change “An Mg-based” to -- A Mg-based --;

Column 6, line 18, change “An Mg-based” to -- A Mg-based --;

Column 6, line 60, change “an Mg-25” to -- A Mg-25 --;

Column 7, line 1, change “an” to -- a --;

Column 7, line 8, change “an Mg-27” to -- a Mg-27 --;

Column 7, line 50, change “an Ni-Mg” to -- a Ni-Mg --;

Column 8, line 3, change “an Mg plating layer or a plating layer of an”
to -- a Mg plating layer or a plating layer of a --;

Column 8, line 5, change “an Mg-based-Zn” to -- a Mg-based-Zn --;

Column 8, line 11, change “an Mg-based” to -- a Mg-based --;

Column 8, line 15, change “an Mg-based-Zn” to -- a Mg-based-Zn --;

Column 8, line 18, change “an Mg-based-Zn” to -- a Mg-based-Zn --;

Column 8, line 25, change “an Mg-based” to -- a Mg-based --;

Column 8, line 65, change “an Mg-based-Zn” to -- a Mg-based-Zn --;

Column 9, line 26, change “an Mg-based” to -- a Mg-based --;

Column 9, line 44, change “an Mg-based” to -- a Mg-based --;

Column 14, line 10, change “an Mg-Zn” to -- a Mg-Zn --;

Column 15, line 66, change “An Mg-Zn” to -- A Mg-Zn --;

Column 16, line 22, change “an Mg phase” to -- a Mg phase --;

Column 16, line 30, change “an” to -- a --;

Column 17, line 61, change “An Mg-Zn” to -- A Mg-Zn --;

Column 21, line 32, change “An Mg-Zn” to -- A Mg-Zn --;

Column 21, line 55, change “An” to -- A --;

Column 31, line 50, change “an Mg-Zn” to -- a Mg-Zn --;

Column 34, line 44, change “an Mg-27” to -- a Mg-27 --;

Column 34, line 47, change “an Mg-27” to -- a Mg-27 --;

Column 34, line 49, change “an Mg-27” to -- a Mg-27 --;

In the Claims

Column 37, line 21, change “An Mg-based” to -- A Mg-based --.

UNITED STATES PATENT AND TRADEMARK OFFICE

CERTIFICATE OF CORRECTION

PATENT NO. : 8,562,757 B2
APPLICATION NO. : 12/450195
DATED : October 22, 2013
INVENTOR(S) : Tokuda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 906 days.

Signed and Sealed this
Fifteenth Day of September, 2015

Michelle K. Lee

Michelle K. Lee
*Director of the United States Patent and Trademark Office*